US009403355B2

(12) United States Patent
Izawa et al.

(10) Patent No.: US 9,403,355 B2
(45) Date of Patent: Aug. 2, 2016

(54) VARIABLE PRINTING MACHINE

(71) Applicants: Hideo Izawa, Narashino (JP); Reishi Fujiwara, Daisen (JP); Kazuhiko Satou, Daisen (JP); Kazumi Odashima, Daisen (JP)

(72) Inventors: Hideo Izawa, Narashino (JP); Reishi Fujiwara, Daisen (JP); Kazuhiko Satou, Daisen (JP); Kazumi Odashima, Daisen (JP)

(73) Assignee: MIYAKOSHI PRINTING MACHINERY CO., LTD., Narashino-shi (JP)

( * ) Notice: Subject to any disclaimer, the term of this patent is extended or adjusted under 35 U.S.C. 154(b) by 0 days.

(21) Appl. No.: 14/066,211

(22) Filed: Oct. 29, 2013

(65) Prior Publication Data

US 2014/0130688 A1 May 15, 2014

(30) Foreign Application Priority Data

Nov. 9, 2012 (JP) ..... 2012-247129

(51) Int. Cl.

| | |
|---|---|
| ***B41F 13/24*** | (2006.01) |
| ***B41F 13/18*** | (2006.01) |
| ***B41F 13/00*** | (2006.01) |
| ***B41F 13/004*** | (2006.01) |
| ***B41F 13/008*** | (2006.01) |

(Continued)

(52) U.S. Cl.

CPC ..... *B41F 13/18* (2013.01); *B41F 13/008* (2013.01); *B41F 13/0024* (2013.01); *B41F 13/0045* (2013.01); *B41F 13/10* (2013.01); *B41F 13/193* (2013.01); *B41F 13/20* (2013.01); *B41F 13/32* (2013.01); *B41F 13/38* (2013.01); *B41F 13/24* (2013.01); *B41P 2213/802* (2013.01); *B41P 2217/15* (2013.01); *B41P 2227/20* (2013.01); *B41P 2227/21* (2013.01)

(58) Field of Classification Search

USPC ..... 101/218

See application file for complete search history.

(56) References Cited

U.S. PATENT DOCUMENTS

| | | | | |
|---|---|---|---|---|
| 2,460,504 A * | 2/1949 | Huebner | ..... | 101/479 |
| 4,111,120 A * | 9/1978 | Paulson | ..... | 101/247 |

(Continued)

FOREIGN PATENT DOCUMENTS

| | | |
|---|---|---|
| DE | 196 43 568 A1 | 6/1997 |
| DE | 10 2007 017097 A1 | 3/2008 |

(Continued)

OTHER PUBLICATIONS

Extended European Search Report dated Mar. 20, 2014, issued in corresponding European Patent Application No. 13191611.6, (3 pages).

*Primary Examiner* — Jill Culler

(74) *Attorney, Agent, or Firm* — Westerman, Hattori, Daniels & Adrian, LLP

(57) ABSTRACT

A variable printing machine for printing images different in top-bottom length with a plate and a blanket cylinder changed in diameter, is provided in which the plate and blanket cylinders and an impression cylinder can be brought into a proper state of contact with one another. Each of a plate cylinder shaft 20 and a blanket cylinder shaft 30 has its one axial end portion supported in a cantilever structure from a main frame 1 of the machine. When the plate cylinder sleeve 21 and the blanket cylinder sleeve 31 are each exchanged with one of different diameter, the blanket cylinder shaft 30 and the impression cylinder 4 are moved relative to each other so that the plate cylinder 2 and the blanket cylinder 3 may be brought into a proper state of contact with each other and so are the blanket cylinder 3 and the impression cylinder 4.

7 Claims, 21 Drawing Sheets

(51) Int. Cl.

| | |
|---|---|
| ***B41F 13/10*** | (2006.01) |
| ***B41F 13/193*** | (2006.01) |
| ***B41F 13/20*** | (2006.01) |
| ***B41F 13/32*** | (2006.01) |
| ***B41F 13/38*** | (2006.01) |

(56) References Cited

U.S. PATENT DOCUMENTS

| | | | | | |
|---|---|---|---|---|---|
| 4,119,032 | A | * | 10/1978 | Hollis | 101/216 |
| 4,913,048 | A | * | 4/1990 | Tittgemeyer | 101/216 |
| 5,241,905 | A | * | 9/1993 | Guaraldi et al. | 101/216 |
| 5,522,316 | A | * | 6/1996 | Singler | 101/479 |
| 5,617,789 | A | * | 4/1997 | Achelpohl et al. | 101/216 |
| 5,678,485 | A | * | 10/1997 | Guaraldi | 101/247 |
| 5,813,336 | A | * | 9/1998 | Guaraldi et al. | 101/218 |
| 5,868,071 | A | * | 2/1999 | Niemiro et al. | 101/218 |
| 5,960,714 | A | * | 10/1999 | Gottling et al. | 101/216 |
| 6,085,651 | A | * | 7/2000 | Defrance et al. | 101/247 |
| 6,494,138 | B1 | * | 12/2002 | Gottling et al. | 101/479 |
| 7,089,858 | B2 | * | 8/2006 | Iwamoto | 101/479 |
| 7,823,506 | B2 | * | 11/2010 | Menu et al. | 101/247 |
| 2009/0199732 | A1 | * | 8/2009 | Beyersdorff | 101/375 |

FOREIGN PATENT DOCUMENTS

| | | | |
|---|---|---|---|
| GB | 2 329 151 | A | 3/1999 |
| JP | 2004-351640 | A | 12/2004 |
| JP | 2009-190402 | A | 8/2009 |

* cited by examiner

VARIABLE PRINTING MACHINE

BACKGROUND OF THE INVENTION

1. Technical Field

The present invention relates to a variable printing machine for printing print images which are different in top-bottom length.

2. Background Art

There has hitherto been proposed a variety of variable printing machines whereby print images different in top-bottom length are printed on a continuous sheet or web of paper so that there may be no extra space between succeeding printed images.

For example, there have been proposed an intermittent feed type variable printing machine (JP 2004-351640 A) and a sleeve exchangeable cylinder type variable printing machine (JP 2009-190402 A).

In an intermittent feed type printing machine, the printing surface is constituted by a circumferential portion of the peripheral surface of a printing cylinder. Printing on the continuous web of paper is effected intermittently by repeating a cycle of its forward feed of travel, stop and backward feed of travel. The top-bottom length of a print image is shorter than the peripheral length of the printing cylinder.

In a sleeve exchangeable cylinder type variable printing machine, a printing sleeve is mounted removably on a supporting shaft to constitute a printing cylinder. The printing surface is constituted by the total length of the peripheral surface of the printing cylinder. The printing sleeve is exchanged among ones of different diameters to change the peripheral length of the printing cylinder for printing. The top-bottom length of a print image is identical to the peripheral length of the printing cylinder.

The intermittent feed type variable printing machine, while furnishing printed images of top-bottom lengths that can be set as desired, cannot much raise the speed of their production because of repetitions of forward feed to travel, stop and backward feed to travel of a continuous web of paper, and it is therefore not suited for large-lot production.

It also raises problems such as that an apparatus needed to so feed a continuous web of paper becomes complex and costly, and a control software required to control operations of the apparatus becomes highly costly.

The sleeve exchangeable cylinder type variable printing machine allows a continuous web of paper to be fed to travel at a fixed rate and achieving an enhanced rate of print production, and hence it is suited for large-lot production. And, the apparatus for feeding a continuous paper is simple and inexpensive and so is a software for controlling operations of the apparatus. Because of change in diameter of a printing cylinder, however, there arises a problem that an impression cylinder may not properly be in contact with the printing cylinder, thereby giving rise to incorrect image printing.

In view of problems as mentioned above, it is an object of the present invention to provide a variable printing machine, i.e. a machine for printing images different in top-bottom length by change in diameter of a printing cylinder, in which the printing cylinder and an impression cylinder can be brought into a proper state of contact with each other, thereby achieving correct image printing.

DISCLOSURE OF THE INVENTION

The present invention provides a variable printing machine, characterized in that it comprises:

a printing cylinder exchangeably mounted on a main frame of the machine, the printing cylinder being exchangeable from one printing cylinder to another, and an impression cylinder mounted on the main frame so as to be movable towards and away from the printing cylinder, whereby the impression and printing cylinders are brought into and held in contact with each other to effect printing.

In the variable printing machine mentioned above, the present invention may specifically be implemented in that the printing cylinder comprises a shaft and a sleeve adapted to be fitted on the shaft so that the sleeve can be fitted on and can be extracted from the shaft, the machine including:

a first end bearing member with which the shaft is rotatably supported at a first axial end portion of the shaft in a cantilever structure from the main frame to render the sleeve exchangeable from one sleeve to another.

If the invention is so implemented as mentioned above, exchanging one sleeve with another of a different diameter on a common shaft allows a printing cylinder to be changed in diameter, facilitating an operation of changing the diameter of a printing cylinder.

In the variable printing machine mentioned above, the present invention may specifically be implemented in that the machine includes a turning frame member having a second end bearing member for supporting a second axial end portion of the shaft rotatably, the turning frame member being mounted on the main frame so as to be turnable between

- a first position where it is positioned (stands or lies) opposite to (facing) a second axial end portion of the printing cylinder and
- a second position where it is separated from the second axial end portion of the printing cylinder so as to render the sleeve extractable from the shaft, the second end bearing member with the turning frame member in the first position being movable between

- a support position where the second end bearing member is fitted on, and thereby rotatably supports, the second axial end portion of the shaft and
- a parted position where it is extracted from, and thereby releases support of, the second axial end portion of the shaft.

With the invention so implemented as mentioned above, the second end bearing member with the turning frame member while in the first position is allowed to take a support position to support the second axial end portion of the shaft rotatably. And, the second end bearing member is allowed, when it takes a parted position, to release support of the second axial end portion of the shaft, whereby it is made possible to support the second axial end portion of the shaft over a long period of time in a state that an axial deflection of or thrust load on the shaft may not develop.

Moreover, from the state that the second end bearing member is moved to lie at the parted position where it comes off and is parted from the second axial end portion of the shaft, the turning frame member is allowed to turn to take the second position where the sleeve can be extracted from, and another sleeve can be fitted on, the common shaft of the printing cylinder, thereby permitting the sleeves to be readily exchanged.

Further, moving the second end bearing member to the parted position whereafter turning the turning frame member over from the first position to the second position prevents the second end bearing member from interfering with the second axial end portion of the shaft to develop such as scoring therein.

In the variable printing machine mentioned above, the present invention may specifically be implemented in that the machine includes a turning frame member being mounted on the main frame and having a second end bearing member for supporting the second axial end portion of the shaft rotatably, wherein the turning frame member is movable between a first position where the turning frame member is positioned opposite to the second axial end portion of the shaft so as to allow the second end bearing member to take a support position where it is fitted on, and support rotatably, the second axial end portion of the shaft and a parting position where the second end bearing member takes a parted position where it is extracted from, and releases support of, the second axial end portion of the shaft, and the turning frame member with the second end bearing member in the parted position is turnable between the parting position and a second position where it is separated from the second axial end portion of the printing cylinder so as to render the sleeve extractable from the shaft.

This, too, allows the second axial end portion to be supported as mentioned above, one sleeve to be exchanged with another as mentioned above and the second end bearing member to be prevented from developing such as scoring as mentioned above.

In the variable printing machine mentioned above, the present invention may specifically be implemented in that the printing cylinder is constituted by a plate and a blanket cylinder, the impression cylinder being brought into and held in contact with the blanket cylinder for printing, the plate cylinder comprises a plate cylinder shaft and a plate cylinder sleeve adapted to be fitted on the plate cylinder shaft so that the sleeve can be fitted on and can be extracted from the plate cylinder shaft, the blanket cylinder comprises a blanket cylinder shaft and a blanket cylinder sleeve adapted to be fitted on the blanket cylinder shaft so that the sleeve can be fitted on and can be extracted from the blanket cylinder shaft, each of the plate and blanket cylinder shafts has a first axial end portion rotatably supported in a cantilever structure with a first end bearing member from the main frame, each of the plate and blanket sleeves is exchangeable from one sleeve to another the blanket cylinder shaft is movable towards and away from the plate cylinder shaft, and the impression cylinder is movable towards and away from the blanket cylinder shaft.

As the invention is so implemented as mentioned above, exchanging each of the plate and blanket cylinders with one of a different diameter changes the diameter of each of the plate and blanket cylinders, permitting images different in top-bottom length to be printed.

Moreover, when each of the plate and blanket cylinders is exchanged with one changed in diameter, moving a new blanket cylinder allows bringing it and a new plate cylinder in a proper state of contact with each other and also allows moving the impression cylinder to bring it and the blanket cylinder in a proper state of contact with each other.

In the variable printing machine mentioned above, the present invention may specifically be implemented in that the main frame has a first and a second side main frame member, the machine including the first and a second end bearing member for plate cylinder and a turning frame member for plate cylinder, the first axial end portion of the plate cylinder shaft being rotatably supported with the first end bearing member for plate cylinder from the first side main frame member, the turning frame member for plate cylinder being mounted on the second side main frame member, turnably between a first position where it is positioned opposite to the second axial end portion of the plate cylinder shaft and a second position where it is separated from the second axial end portion of the plate cylinder shaft so as to render the plate cylinder sleeve extractable from the plate cylinder shaft, and the turning frame member for plate cylinder having the second end bearing member for plate cylinder for supporting a second axial end portion of the plate cylinder shaft so as to be rotatable; the machine further including a first and a second side auxiliary frame member mounted on the first side main frame member and the second side main frame member so as to be movable towards and away from the plate cylinder shaft, respectively, and the first and a second end bearing member for blanket cylinder and a turning frame member for blanket cylinder, the first axial end portion of the blanket cylinder shaft being rotatably supported with the first end bearing member for blanket cylinder from the first side auxiliary frame member, the turning frame member for blanket cylinder being mounted on the second side auxiliary frame member, turnably between a first position where it is positioned opposite to the second axial end portion of the blanket cylinder shaft and a second position where it is separated from the second axial end portion of the blanket cylinder shaft so as to render the blanket cylinder sleeve extractable from the blanket cylinder shaft, and the turning frame member for blanket cylinder having the second end bearing member for blanket cylinder for supporting the second axial end portion of the blanket cylinder shaft so as to be rotatable;

the second end bearing members for plate and blanket cylinders with the turning frame members for plate and blanket cylinders each at the first position being each movable between a support position where it is fitted on, and rotatably supports, the second axial end portion of the plate/blanket cylinder shaft and a parted position where it is extracted from, and releases support of, the second axial end portion of the plate/blanket cylinder shaft.

In this way, the first and second side auxiliary frame members can be moved to move the blanket cylinder towards and away from the plate cylinder shaft.

In the variable printing machine mentioned above, the present invention may specifically be implemented in that the turning frame member for plate cylinder has a plate cylinder housing member provided with the second end bearing member for plate cylinder and being movable between a position where it takes the support position and a position where it takes the parted position, the turning frame member for blanket cylinder has a blanket cylinder housing member provided with the second end bearing member for blanket cylinder and being movable between a position where it takes the support position and a position where it takes the parted position, and move units are provided at opposite sides across the second end bearing members in the housing members for plate and blanket cylinders, respectively, the move units being operable to move the housing members, respectively.

Operating a plurality of move units in the arrangement mentioned above allows moving the housing relative to the turning frame member.

In the variable printing machine mentioned above, the present invention may specifically be implemented in that the main frame has a first and a second side main frame member, the machine including a first and a second end bearing member for plate cylinder and a turning frame member for plate cylinder, the first axial end portion of the plate cylinder shaft being rotatably supported with the first end bearing member for plate cylinder from the first side main frame member, the turning frame member for plate cylinder being mounted on the second side main frame member of the main frame and having a second end bearing member for plate cylinder for supporting a second axial end portion of the plate cylinder shaft rotatably, the turning frame member for plate cylinder being movable between a first position where the turning frame member for plate cylinder is positioned opposite to the second axial end portion of the plate cylinder so as to allow the second end bearing member for plate cylinder to take a support position where it is fitted on, and rotatably supports, a second axial end portion of the plate cylinder shaft and a parting position where the second end bearing member for plate cylinder takes a parted position where it is extracted from, and releases support of, the second axial end portion of the plate cylinder shaft, the turning frame member for plate cylinder with the second end bearing member in the parted position being turnable between the parting position and a second position where it is separated from the second axial end portion of the plate cylinder so as to render the plate cylinder sleeve extractable, the machine further including a first and a second side auxiliary frame member mounted on the first and second side main frame members, respectively, so as to be movable towards and away from the plate cylinder shaft, and a first and a second end bearing member for blanket cylinder and a turning frame member for blanket cylinder, the first axial end portion of the blanket cylinder shaft being rotatably supported with the first end bearing member for blanket cylinder from the first side auxiliary frame member, the turning frame member for blanket cylinder being mounted on the second side auxiliary frame member and having the second end bearing member for blanket cylinder for supporting a second axial end portion of the blanket cylinder shaft rotatably, the turning frame member for blanket cylinder being movable between a first position where the turning frame member for blanket cylinder is positioned opposite to the second axial end portion of the blanket cylinder so as to allow the second end bearing member for blanket cylinder to take a support position where it is fitted on, and rotatably supports, the second axial end portion of the blanket cylinder shaft and a parting position where the second end bearing member for blanket cylinder takes a parted position where it is extracted from, and releases support of, the second axial end portion of the blanket cylinder shaft, the turning frame member for blanket cylinder with the second end bearing member in the parted position being turnable between the parting position and a second position where it is separated from the second axial end portion of the blanket cylinder so as to render the blanket cylinder sleeve extractable.

In this way, too, the first and second side auxiliary frame members can be moved to move the blanket cylinder towards and away from the plate cylinder shaft.

In the variable printing machine mentioned above, the present invention may specifically be implemented in that the machine further includes a first side arm swingably attached to the first side main frame member, a second side arm swingably attached to the first side main frame member, the impression cylinder being mounted between the first and second side arms, and a means for swinging the first and second side arms in synchronism with each other to move the impression cylinder towards and away from the blanket cylinder.

This allows an impression cylinder to be simply moved to come in a proper state of contact with the plate and blanket cylinder whose diameters are each changed.

According to the present invention, changing the diameter of a printing cylinder allows print images different in top-bottom length to be printed on a continuous sheet or web of paper so as to leave no extra space between succeeding printed images thereon. And, moving an impression cylinder by a particular distance in accordance with a particular diameter of the printing cylinder for printing allows bringing about a proper state of contact of the impression cylinder with the printing cylinder, thereby yielding correct printed images.

BEST MODES FOR CARRYING OUT THE INVENTION

Figure 1:
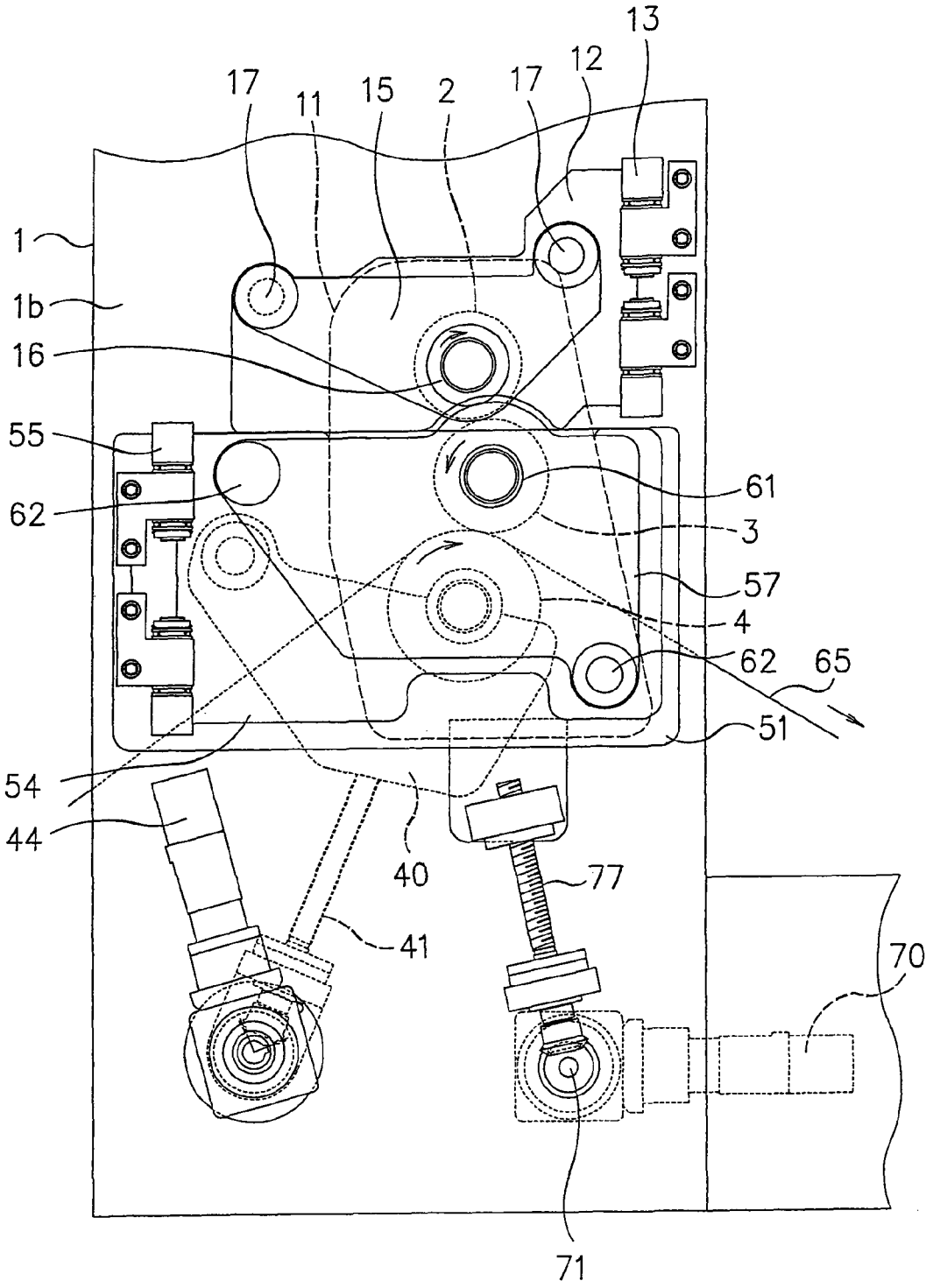
FIG. 1 is diagrammatic front view of a variable printing machine, illustrating a form of implementation of the present invention.

As shown in FIG. 1, a main frame 1 has a plate cylinder 2, a blanket cylinder 3 and an impression cylinder 4 rotatably mounted thereon, the plate and blanket cylinders 2 and 3 each constituting a printing cylinder.

A printing sheet or web of paper 65 is nipped between the blanket and impression cylinders 3 and 4 and fed to travel rightwards (in the direction of the arrow) as it is wound on the impression cylinder 4 while having a print image printed thereon.

Figure 2:
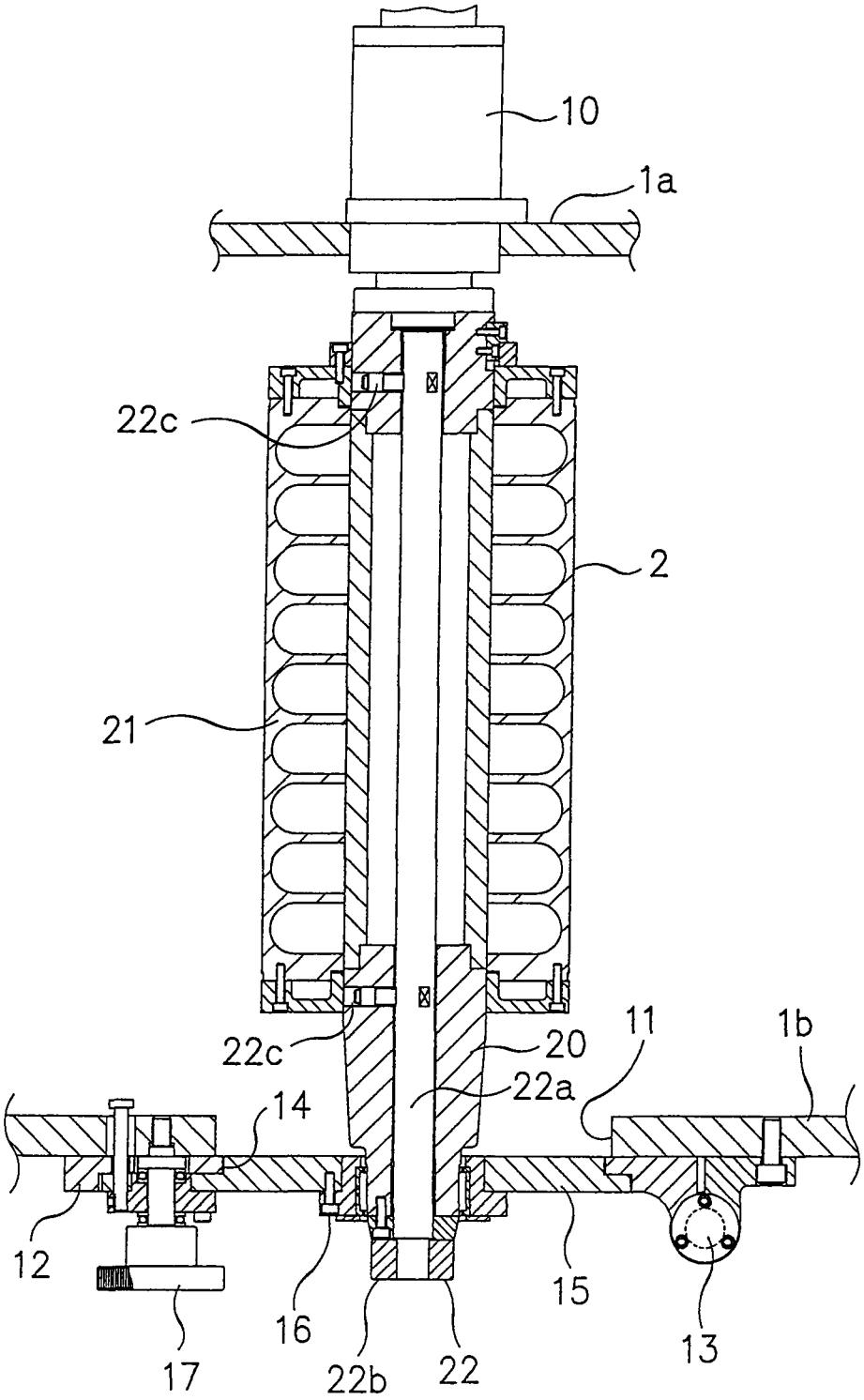
FIG. 2 is a transverse sectional view enlarged in detail of a plate cylinder mounting structure in the machine shown in FIG. 1.

As shown in FIGS. 1 and 2, the main frame 1 has a first side main frame member 1*a* and a second side main frame member 1*b* on a first side (one side) and a second side (the other side) axial of the cylinders, respectively.

The plate cylinder 2 has a plate cylinder shaft 20 and a plate cylinder sleeve 21 removably mounted to fit on the plate cylinder shaft 20 so as to be fitted on and to be extracted from the plate cylinder shaft 20.

The plate cylinder shaft 20 and the plate cylinder sleeve 21 for their joint rotation are made integral with each other by fitting a key (not shown) on the plate cylinder shaft side in a key groove (not shown) on the plate cylinder sleeve side.

The plate cylinder shaft 20 and the plate cylinder sleeve 21 can be made fastened together by a fixing mechanism 22 so that they may not axially move relatively. Such fastening can also be made released, i.e. unfastened.

The fixing mechanism 22 has a rotary shaft 22*a* rotatably mounted in an axial center of the plate cylinder shaft 20, a fastening finger knob 22*b* attached to a second side axial end portion of the rotary shaft 22*a*, and an axial pair of lugs (coupling members) 22*c* which can each be pushed against an inner peripheral surface of the plate cylinder sleeve 21 by a cam (not shown) formed on an outer peripheral surface of the rotary shaft 22*a*. The lug 22*c* pushed against the inner peripheral surface of the plate cylinder sleeve 21 is fastened thereto, fastening the plate cylinder shaft 20 and the plate cylinder sleeve 21 together by frictional force so that they may not move axially relative to each other. When the lug 22*c* is parted from the inner peripheral surface of the plate cylinder sleeve 21, the plate cylinder shaft 20 and the plate cylinder sleeve 21 are unfastened so that they may axially move relative to each other.

A first axial end of the plate cylinder shaft 20 is axially supported in a cantilever structure with a first end bearing member 10 with which the first side main frame member 1*a* is provided. This allows one plate cylinder sleeve 21 to be exchanged at the side of the second side main frame member 1*b* with another plate cylinder sleeve 21 different in diameter, thereby changing the diameter of the plate cylinder plate 21.

The second side main frame member 1*b* has an opening 11 for insertion and extraction of the plate cylinder 2 and is provided with a turning frame member for plate cylinder 12 which is mounted on thereon so as to be turnable horizontally by a hinge 13.

The turning frame member for plate cylinder 12 is turned between a first position where it lies in contact with the outer surface of the second side main frame member 1*b* and stands (or lie) opposite to or facing the second axial end portion of the plate cylinder 2 and a second position where it lies out of contact with the outer surface of the second side main frame member 1*b* and is separated from the second axial end portion of the plate cylinder 2, permitting the plate cylinder sleeve 21 to be extracted through the opening 11.

The turning frame member for plate cylinder 12 has a hole 14 through which a portion of the plate cylinder shaft 20 that is closer to its second axial end portion can pass, and in which a plate cylinder housing member 15 is fitted so that it is attached to the turning frame member for plate cylinder 12.

With a second end bearing member 16 mounted in the cylinder plate housing member 15, the second axial end portion of the plate cylinder shaft 20 is supported so that it can be rotated and it can be inserted and pulled out.

And, when the turning frame member for plate cylinder 12 is at the first position, operating a move unit 17 moves the plate cylinder housing member 15 towards and away from the turning frame member for plate cylinder 12. The plate cylinder housing member 15 while maintaining its position parallel to the turning frame member for plate cylinder 12 is moved between a position where the second end bearing member 16 takes a support position to support the second axial end portion of the plate cylinder shaft 20 and a position where it takes a release or parted position to release the support.

As shown in FIG. 1, the move unit 17 is provided at each of both right hand side and left hand side of the plate cylinder housing member 15 while the plate cylinder shaft 20 of the plate cylinder 2 is supported at a position intermediate between the right and left hand sides of the plate cylinder housing member 15 so that operating the right hand and left hand move units 17 translates the plate cylinder housing member 15 axially of the plate cylinder shaft 20.

Figure 3:
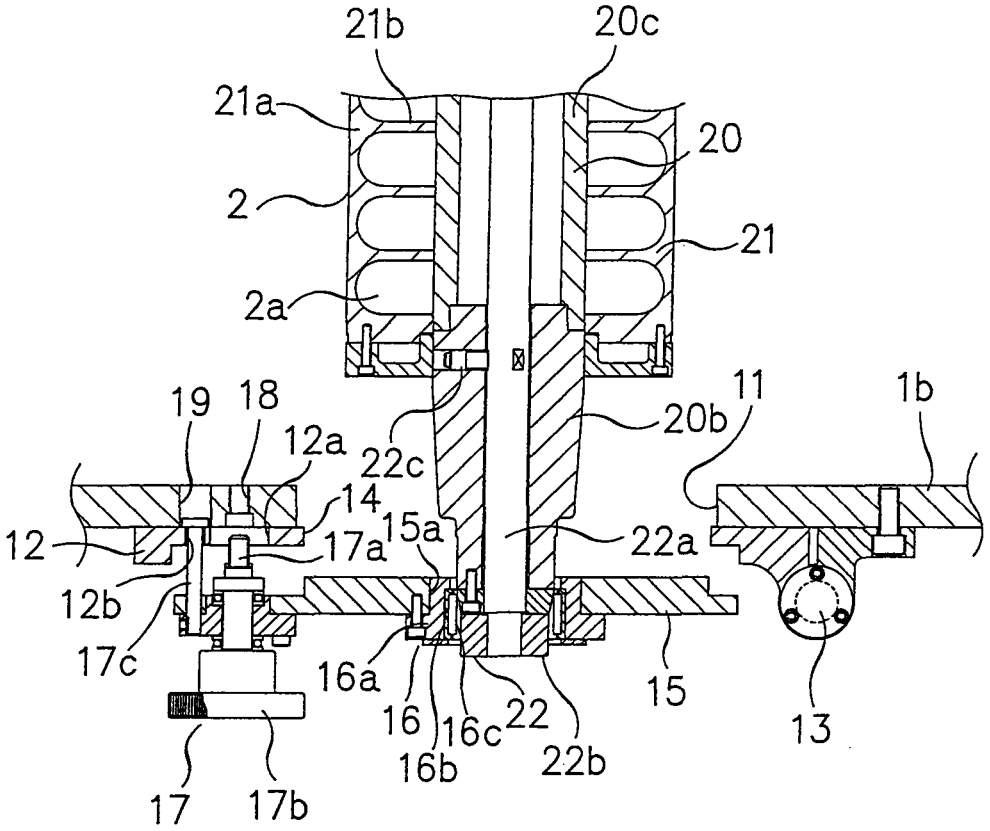
FIG. 3 is a sectional view illustrating a plate cylinder shaft in the state that support of its second axial end portion is released.

The second end bearing member 16 as shown in FIG. 3 comprises a cylindrical bearing box 16*a* fitted in and fastened to a hole 15*a* in the plate cylinder housing member 15, a bearing 16*b* attached to the bearing box 16*a* and a bearing inner ring 16*c* incorporated in the bearing 16*b* through a slidable needle-type or cylindrical bearing. The second axial end portion of the plate cylinder shaft 20 is fitted in bearing inner ring 16*c* so that it can be inserted and extracted.

The move unit 17 as shown in FIG. 3 has a male screw 17*a* fitted to the plate cylinder housing member 15 so that it can be rotated but may not be moved axially, a fixing knob 17*b* with which the male screw 17*a* is provided and a guide bar 17*c* fixed to the plate cylinder housing member 15.

The male screw 17*a* is let into and through a hole 12*a* in the turning frame member for plate cylinder 12 to screw with a female screw 18 in the second side main frame member 1*b*.

The guide bar 17*c* is let into and through a hole 12*b* and then into a guide hole 19 in the second side main frame member 1*b*, there by guiding the plate cylinder housing member 15 so as to be movable axially of the plate cylinder 2.

The guide bar 17*c* has an end portion larger in diameter than the hole 12*b* so that it may not come off the hole 12*b*, limiting its movement towards the second side of the plate cylinder housing member 15.

In this manner, the plate cylinder housing member 15 can, with the guide bar 17*c* and the hole 12*b*, be moved smoothly while maintaining its axial parallel position.

And, starting from the state that the male screw 17 comes in contact with the female screw 18, the fixing knob 17*b* is rotated in the direction in which the male screw 17*a* fastens to screw with the female screw 18. This allows the plate cylinder housing member 15 to be moved towards the first axial side and, as shown in FIG. 2, to be fitted in the hole 14 in the turning frame member for plate cylinder 12. The bearing inner ring 16*c* of the second end bearing member 16 is then fitted on the second axial end portion of the plate cylinder shaft 20, permitting the second axial end portion of the plate cylinder shaft 20 to be engaged, and supported rotatably, with the second end bearing member 16.

Rotating the fixing knob 17*b* in the direction in which the male screw 17*a* loosens in the state shown in FIG. 2 moves the plate cylinder housing member 15 towards the second axial side and in the direction in which the bearing inner ring 16*c* of the second end bearing member 16 comes out of the second axial end portion of the plate cylinder shaft 20.

And, from the state that the male screw 17*a* comes out of the female screw 18, the plate cylinder housing member 15 with the fixing knob 17*b* held in a hand is moved towards the second axial side to cause the second end bearing member 16 as sown in FIG. 3 to take a release or parted position where its bearing inner ring 16*c* is parted from the second axial end portion of the plate cylinder shaft 20, releasing support of the latter.

Since the plate cylinder housing member 15 is moved axially of the plate cylinder 2 relative to the turning frame member for plate cylinder 12 and thereby the second end bearing member 16 (the bearing inner ring 16*c*) is fitted on, and extracted from or pulled out of, the second axial end portion of the plate cylinder shaft 20 in this manner, the second end bearing member 16 is prevented from undergoing a partial wear due to scoring as in the case when it is simply fitted on and pulled out of the second axial end portion of the plate cylinder shaft 20. Hence, the second end bearing member is rendered capable of rotatably supporting the shaft stably and without development of axial deflection of or thrust load on the shaft over a long period of time.

Mention is next made of an operation to alter the diameter of the plate cylinder 2.

FIG. 2 shows the state of printing operation. In this state, the turning frame member for the plate cylinder 12 is at the first position, the plate cylinder housing 15 is received and fitted in the hole 14 of the turning frame member for plate cylinder 12 and the second end bearing member 16 is at the support position where it is fitted on and thereby supports the second axial end portion of the plate cylinder shaft 20.

From the state shown in FIG. 2, operating the move unit 17 to move the plate cylinder housing member 15 causes the second end bearing member 16 to take the parted position where it is parted from, and thereby releases support of, the second axial end portion of the plate cylinder shaft 20 as shown in FIG. 3.

Figure 4:
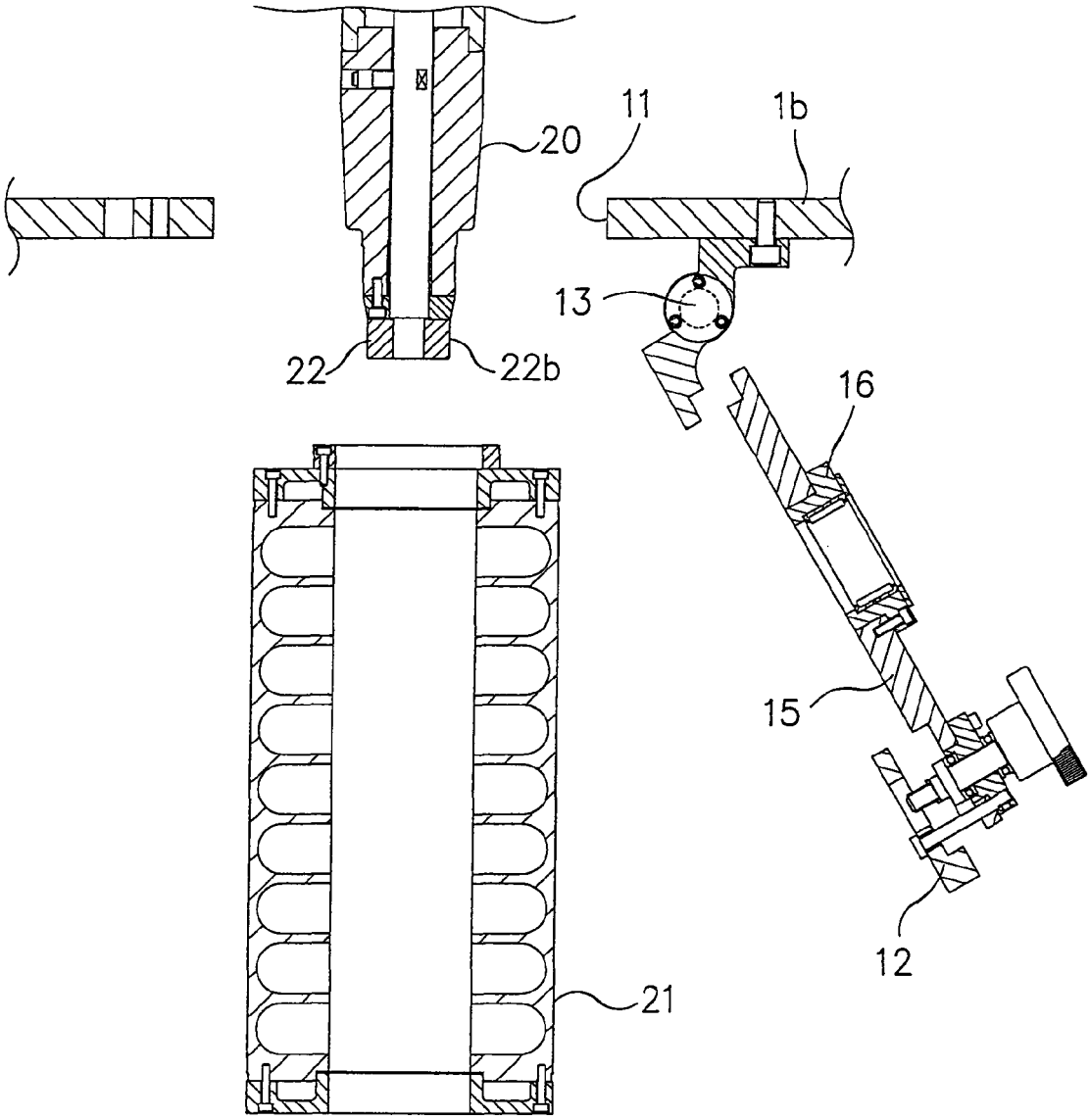
FIG. 4 is a sectional view illustrating a plate cylinder sleeve in the state that it is extracted.

From the state shown in FIG. 3, the turning frame member for plate cylinder 12 is turned on the hinge 13 towards the second position to take the second position shown in FIG. 4 where the opening portion 11 of the second side main frame member 1*b* is opened.

The fixing finger member 22*b* of the fixing mechanism 22 is rotated to release axial fixing between the plate cylinder shaft 20 and the plate cylinder sleeve 21, making the plate cylinder sleeve 21 slidably movable axially of the plate cylinder shaft 20.

As shown in FIG. 4, the plate cylinder sleeve 21 is extracted axially of the plate cylinder shaft 20 and removed from the plate cylinder shaft 20.

And, a plate cylinder sleeve 21 of a different diameter is inserted axially of the plate cylinder shaft 20, and the plate cylinder sleeve 21 on fitting the key and key groove together by a turn of the plate cylinder sleeve 21 is fitted on the plate cylinder shaft 20.

By a further turn of the fixing finger member 22*b* of the fixing mechanism 22, the plate cylinder shaft 20 and the plate cylinder sleeve 21 are frictionally fastened and fixed together so that they may not be moved axially.

Next, in the state that the plate cylinder housing member 15 lies at the position where the second end bearing member 16 takes the parted position, the turning frame member for plate cylinder 12 is turned on the hinge 13 to the position where the axial center of the second end bearing member 16 and the axial center of the plate cylinder shaft 20 are made coincident with each other (see FIG. 3).

With the fixing knob 17*b* in the fixing mechanism 17 thrust by a hand, the plate cylinder housing member 15 is moved towards the first side to press the male screw 17*a* against the female screw 18. Pressing the male screw 17*a* against the female screw 18 while turning the fixing knob 17*b* screws the male screw 17*a* into the screw 18. A force of screwing which then develops is used to fit and thrust the bearing ring 16*c* of the second end bearing member 16 onto the second axial end portion of the late cylinder shaft 20. The second end bearing member 16 is thus brought into a support state that it supports rotatably the second axial end portion of the plate cylinder shaft 20 as shown in FIG. 2. Also, the plate cylinder housing member 15 is pressed against the turning frame member for plate cylinder 12 to press the turning frame member for plate cylinder 12 against the outer surface of the second side main frame member 1*b*, fixing it at the first position.

Mention is next made of a mounting structure of the blanket cylinder 3.

Figure 5:
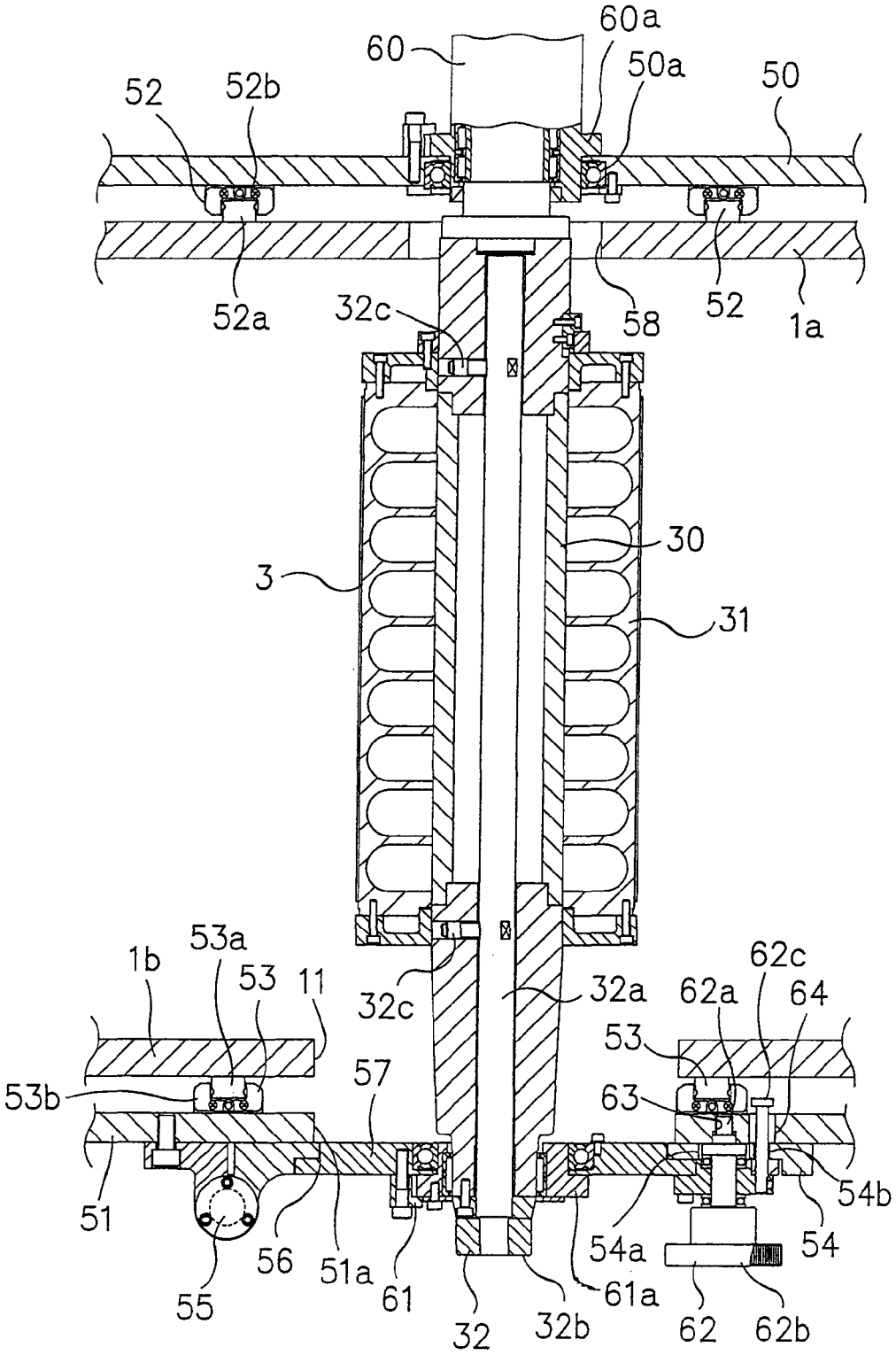
FIG. 5 is a transverse sectional view enlarged in detail of a blanket cylinder mounting structure in the machine shown in FIG. 1.

As shown in FIGS. 1 and 5, the first and second side main frame members 1*a* and 1*b* of the main frame 1 are provided outside with a first and a second side auxiliary frame member 50 and 51, respectively, which are movable towards and away from the plate cylinder 2.

For example, a right and left hand side pair of first side linear guide members 52 is mounted on the outer surface of the first side main frame member 1*a* so as to make the first side auxiliary frame member 50 movable towards and away from the plate cylinder 2.

A right and left hand side pair of second side linear guide members 53 is mounted on the outer surface of the second side main frame member 1*a* so as to make the second side auxiliary frame member 50 movable towards and away from the plate cylinder 2

The first and second side liner guide members 52 and 53 comprise rails 52*a* and 53*a* attached to the outer surfaces of the first and second side main frame members 1*a* and 1*b*, respectively and guides 52*b* and 53*b* with which the first and second side auxiliary frame members 50 and 51 are provided on their inner surfaces, respectively. The guides 52*b* and 53*b* are provided on the rails 52*a* and 53*a* to move along them slidably, respectively.

The blanket cylinder 3 has a blanket cylinder shaft 30 and a blanket cylinder sleeve 31 removably fitted on the blanket cylinder shaft 30 so as to be fitted on and to be extracted from the plate cylinder shaft 30.

The blanket cylinder shaft 30 and the blanket cylinder sleeve 31 for their joint rotation are made integral with each other by fitting a key in a key groove.

The blanket cylinder shaft 30 and the blanket cylinder sleeve 31 can be made fastened together by a fixing mechanism 32 so that they may not axially move relatively. Such fastening can also be made released, i.e. unfastened.

The fixing mechanism 32 as with the fixing mechanism 22 for the plate cylinder 2 is provided with a rotary shaft 32*a,* a finger knob 32*b* and a lug (coupling member) 32*c.*

To wit, the blanket cylinder 3 is essentially identical in structure to the plate cylinder 2.

The second side auxiliary frame member 52 has a turning frame member for blanket cylinder 54 mounted thereon so as to be turnable horizontally on a hinge 55.

The turning frame member for blanket cylinder 54 is turned between a first position where it closes an opening 51*a* of the second side auxiliary frame member 51 and stands opposite to a second axial end portion of the blanket cylinder shaft 30 and a second position where it opens the opening 51*a* to allow the blanket cylinder sleeve 31 to be extracted through the opening 11. The opening 51*a* is opposite to the opening 11 of the second side main frame member 1*b.* Through these openings 11 and 51*a* the blanket cylinder 3 can be passed.

The turning frame member for blanket cylinder 54 has a hole 56 in which the blanket cylinder housing member 57 is fitted so that it is attached to the turning frame member for blanket cylinder 54.

A first axial end portion of the blanket cylinder shaft 30 passes through a hole 58 in the first side main frame member 1*a* and is supported in a cantilever structure with a first end bearing member 60 with which the first side auxiliary frame member 50 is provided.

The second axial end portion of the blanket cylinder shaft 30 passes through the opening 11 of the second main frame member 1*b,* and through the opening 51*a* of the second side auxiliary frame member 51, projecting towards the second axial side. The second axial end portion is supported with a second end bearing member 61 in the blanket cylinder housing member 57 so that it can be rotated and axially inserted and extracted.

And, by operating a move unit 62, the blanket cylinder housing member 57, when the turning frame member for blanket cylinder 54 is at the first position, is moved towards and away from the turning frame member for blanket cylinder 54 and translated axially of the blanket cylinder 3 between a position where the second end bearing member 61 takes a support position and a position where it takes a parted position.

The second end bearing member 61 when in the support position is fitted on, and rotatably supports, the second axial end portion of the blanket cylinder shaft 30 and when at the parted position is extracted from, and releases the support of, the second axial end portion.

The second end bearing member 61 as with the second end bearing member 16 provided in the plate cylinder 15 mentioned above, is provided with a bearing box 61*a,* a bearing 61*b* and a rearing inner ring 61*c* in which the second axial end portion of the blanket cylinder shaft 30 is fitted so as to be insertable and extractable.

The move unit 62 as with the move unit 17 provided in the plate cylinder housing member 15 is provided with a female screw 62*a,* a fixing knob 62*b* and a guide bar 62*c.*

The male screw 62*a* is passed through a hole 54*a* in the turning frame member for blanket cylinder 54 and screwed with a female screw 63 in the second side auxiliary frame member 51.

With the guide bar 62*c* passed through a hole 54*b* of the turning frame member 54 and inserted into a guide bore 64 in the second side auxiliary frame member 51, the blanket cylinder housing member 57 is guided so as to be movable axially of the blanket cylinder 3.

The guide bar 62*c* has an end portion larger in diameter than the hole 54*b* so that it may not be pulled out of the hole 54*b,* limiting its movement towards the second side of the blanket cylinder housing member 57.

The move unit 62 as shown in FIG. 1 is provided at each of both right hand side and left hand side of the blanket cylinder housing member 57 and the blanket cylinder shaft 30 of the blanket cylinder 3 is supported at a position intermediate between the right and left hand sides of the blanket cylinder housing member 57 so that operating the right hand and left hand move units 62 translates the plate cylinder housing member 57 axially of the blanket cylinder shaft 30.

To wit, the mounting structure of the blanket cylinder 3 is shown that is in large part identical to that of the plate cylinder 2 and differs in that while the plate cylinder 2 is supported by the first side main frame member 1*a* and the plate cylinder housing 15 attached to the turning frame member 12 mounted on the second side main frame member 1*b,* the blanket cylinder 3 is supported by the first side auxiliary frame member 50 and the blanket cylinder housing member 57 attached to the turning frame member for blanket cylinder 54 mounted on the second side auxiliary frame member 51.

The auxiliary frame member 50, 51 is used to move the blanket cylinder 3 towards and away from the plate cylinder 2 as will be mentioned later herein.

The blanket cylinder 3 as with the plate cylinder 2 is exchangeable.

Figure 6:
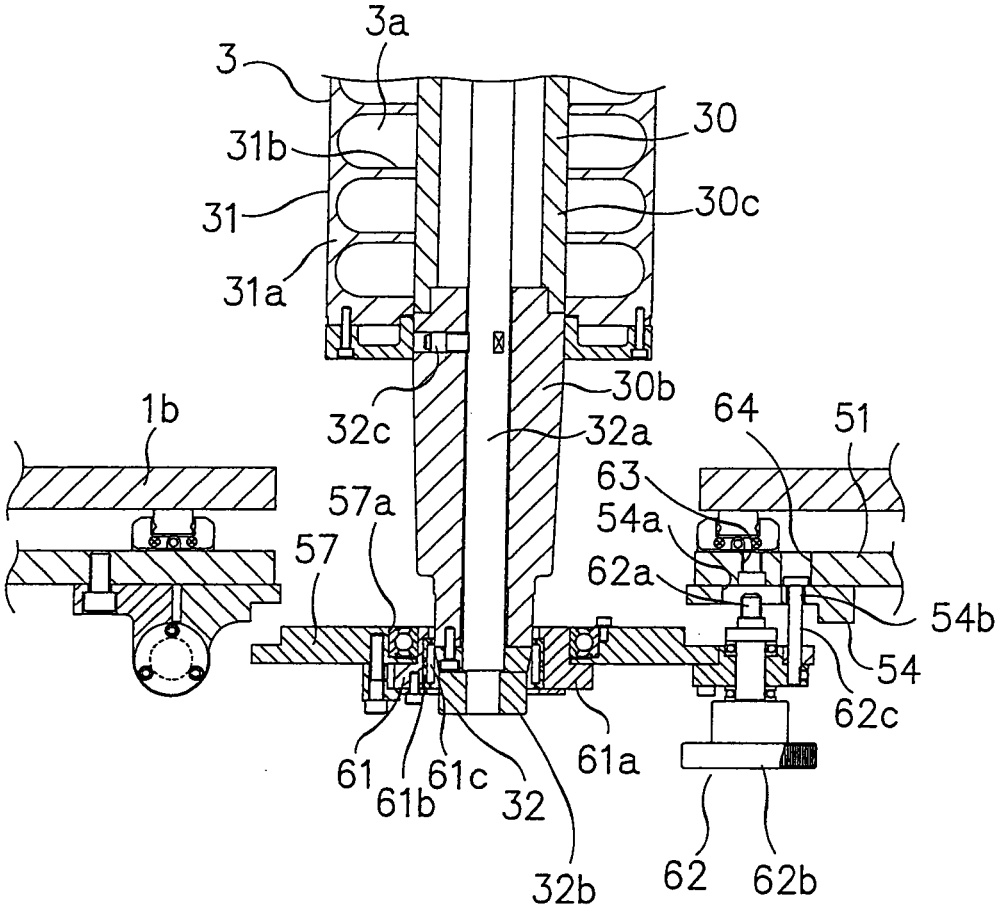
FIG. 6 a sectional view illustrating a blanket cylinder shaft in the state that support of its second axial end is released.

To wit, the blanket cylinder housing member 57 by operating the move unit 62 is moved from the state of printing operation shown in FIG. 5 to the parting position where the second end bearing member 61 takes the parted position as shown in FIG. 6, thereby releasing support of the second axial end portion of the blanket cylinder shaft 30 by the second end bearing member 61.

Figure 7:
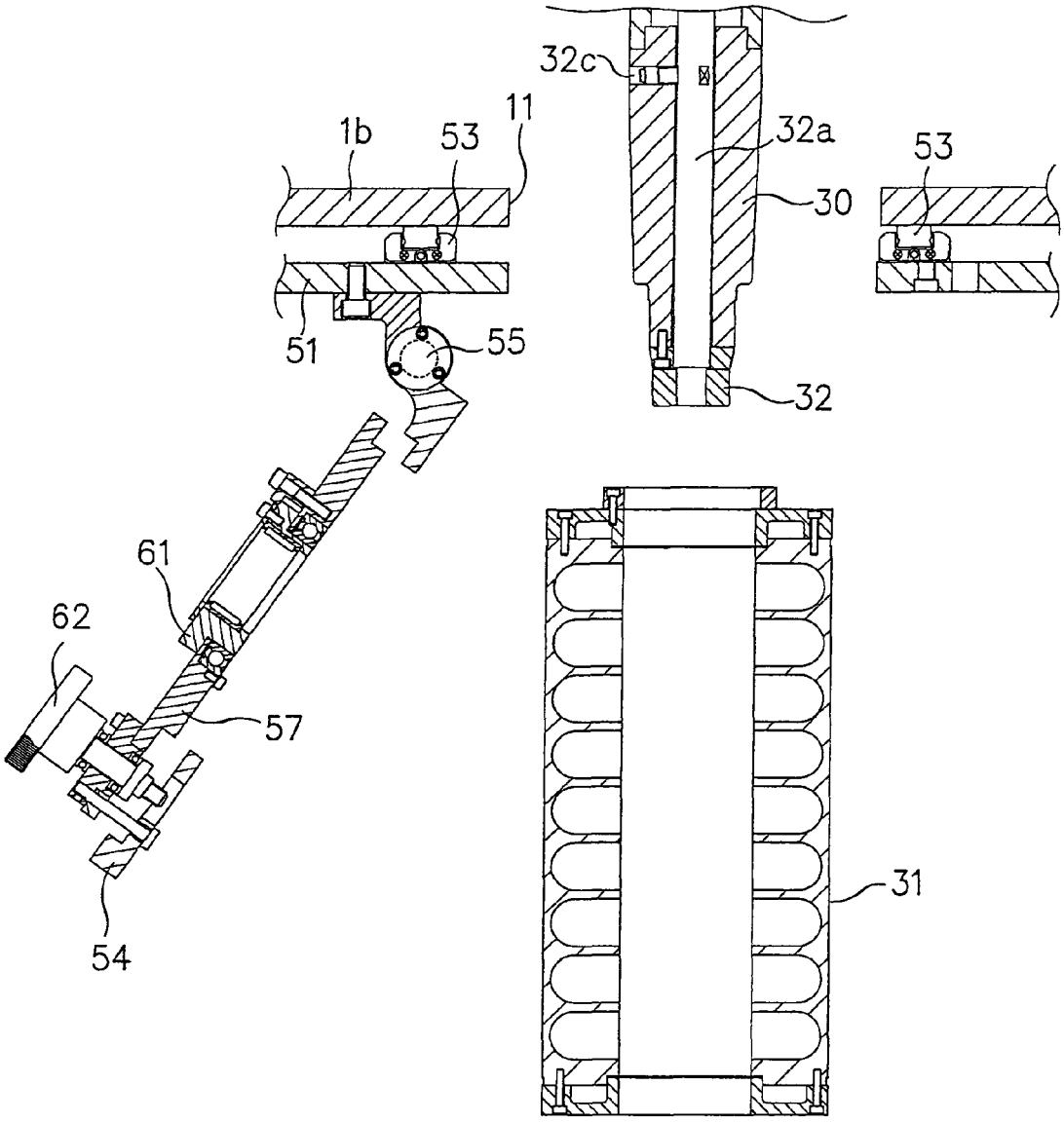
FIG. 7 is a sectional view illustrating a blanket cylinder sleeve in the state that it is extracted.

And, as shown in FIG. 7, after the turning frame member for blanket cylinder 54 is turned on a hinge 55 to a second position, axial fixing between the blanket cylinder shaft 30 and the blanket cylinder sleeve 31 by the fixing mechanism 32 is released and the blanket cylinder sleeve 31 is pulled out.

A blanket cylinder sleeve 31 of a different diameter is fitted on the blanket cylinder shaft 30 and, by fitting the key and key groove, is fastened thereto so that the blanket cylinder sleeve 31 may not be rotated relative thereto.

By operating the fixing mechanism 32, the blanket cylinder sleeve 31 is fixed to the blanket cylinder shaft 30 so as not to be axially moved relative thereto.

The turning frame member for blanket cylinder 54 is turned to return to the first position shown in FIG. 6 where the second end bearing member 61 and the blanket cylinder shaft 30 are allowed to coincide with each other in axial center.

Thereafter, the blanket cylinder housing member 57 by operating the move unit 62 is moved towards the first axial side to allow the second end bearing member 61 as shown in FIG. 5 to be fitted on the second axial end portion of the blanket cylinder shaft 30 and to rotatably support the second axial end portion. The turning frame member for blanket cylinder 54 is then fastened to the second side auxiliary frame member 51.

The first and second end bearing members 60 and 61 with which the first and second axial end portions of the blanket cylinder shaft 30 are rotatably supported from the first and second side auxiliary frame members 50 and 51, respectively, are each of eccentric bearing to allow the blanket cylinder 3 to move away from the plate cylinder 2 and the impression cylinder 4.

For example, the second end bearing member 62 has the bearing box 61*a* whose inner peripheral surface is decentered to its outer peripheral surface and which is fitted rotatably in a bore 57*a* of the blanket cylinder housing member 57. Rotating the bearing box 61*a* by a rotary means (not shown) displaces the blanket cylinder shaft 30, thereby moving the blanket cylinder 3 towards and away from the plate cylinder 2 and the impression cylinder 4.

Likewise, the first end bearing member 60 has the bearing box 60*a* whose inner peripheral surface is decentered to its outer peripheral surface and which is rotatably received and supported in a bore 50*a* of the first side auxiliary frame member 50.

The rotary means for the bearing box 61*a* may be of, though not limited to, a structure with an arm fixed to the bearing box 61*a* and having a link connected thereby which is swung by a cylinder or an electric motor to rotate the gear box 61*a*.

As the blanket cylinder 3 is moved away from the plate and impression cylinders 2 and 4, the operation to exchange a plate on the plate cylinder 2 is facilitated, also facilitating an operation of paper passing.

As mentioned above, exchanging the plate and blanket cylinder sleeves 21 and 31 with ones different in diameter to change the peripheral length of the plate and blanket cylinders 2 and 3 allows printing images different in top-bottom length. As the diameter of the plate and blanket cylinders 2 and 3 is changed, however, the state arises that the plate and blanket cylinders 2 and 3 are not properly in contact with each other.

Accordingly, the present invention provides a variable printing machine in which with the center of a plate cylinder 2 (the center of a plate cylinder shaft 20) fixed in position, the center of a blanket cylinder 3 (the center of a blanket cylinder shaft 30) is moved in accordance with a top-bottom length of print images (a diameter of the plate cylinder 2, the blanket cylinder) whereby the plate and blanket cylinders 2 and 3 are positioned properly in contact with each other.

Specifically, a first and a second side auxiliary frame member 50 and 51 are moved towards a first and a second side main frame member 1*a* and 1*b* to move the blanket cylinder 3 towards and away from the plate cylinder, thereby changing a distance in center between the plate and blanket cylinders 2 and 3 whereby if the plate and blanket cylinders 2 and 3 are changed in diameter, it is ensured that the plate and blanket cylinders 2 and 3 are positioned in a proper state of contact with each other.

Figure 8:
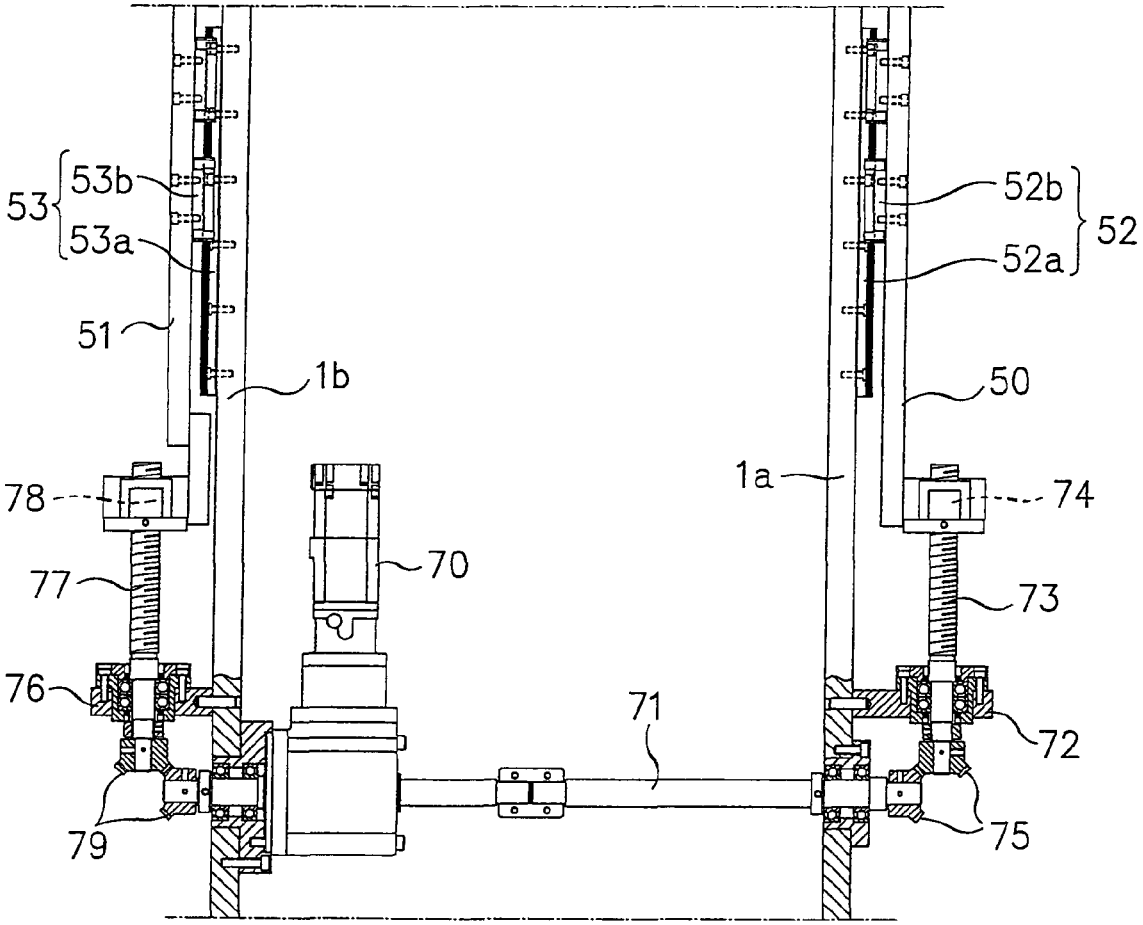
FIG. 8 is a longitudinal sectional view illustrating a mechanism for moving an auxiliary frame member.

Mention is made of a mechanism for moving the first and second side auxiliary frame members 50 and 51 with reference to FIGS. 1 and 8.

A drive shaft 71 for rotation by a motor for movement 70 is rotatably supported with the first and second side main frame members 1*a* and 1*b*.

A first side feed ball screw 73 is mounted rotatably with a bracket 72 on the first side main frame member 1*a*. A first end of the first side feed ball screw 73 is screwed with a first side ball nut 74 provided in the first side auxiliary frame member 50 and its second end is connected to a first end portion of the drive shaft 71 with a bevel gear 75 to constitute a first side ball screw mechanism.

A second side feed ball screw 77 is mounted rotatably with a bracket 76 on the second side main frame member 1*b*. A first end of the second side feed ball screw 77 is screwed with a second side ball nut 78 provided in the second side auxiliary frame member 51 and its second end is connected to a second end portion of the drive shaft 71 with a bevel gear 79 to constitute a second side ball screw mechanism.

Figure 9:
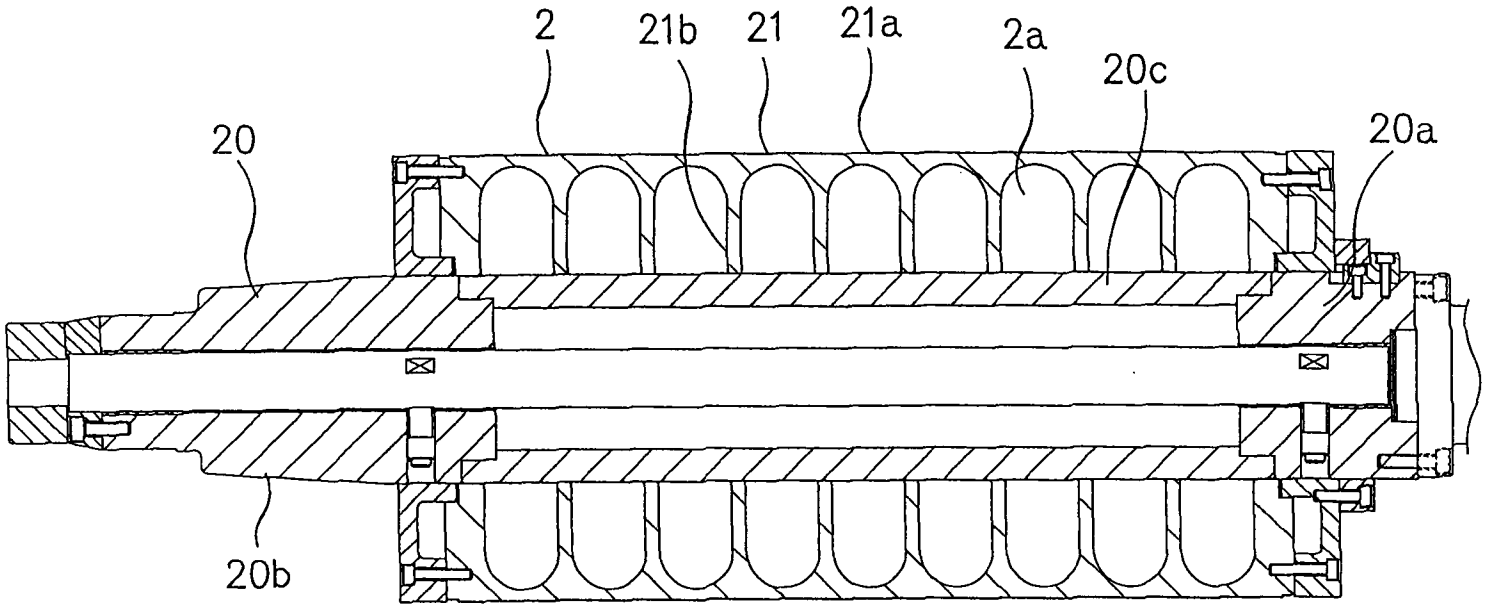
FIG. 9 is a sectional view of a plate cylinder.
Figure 10:
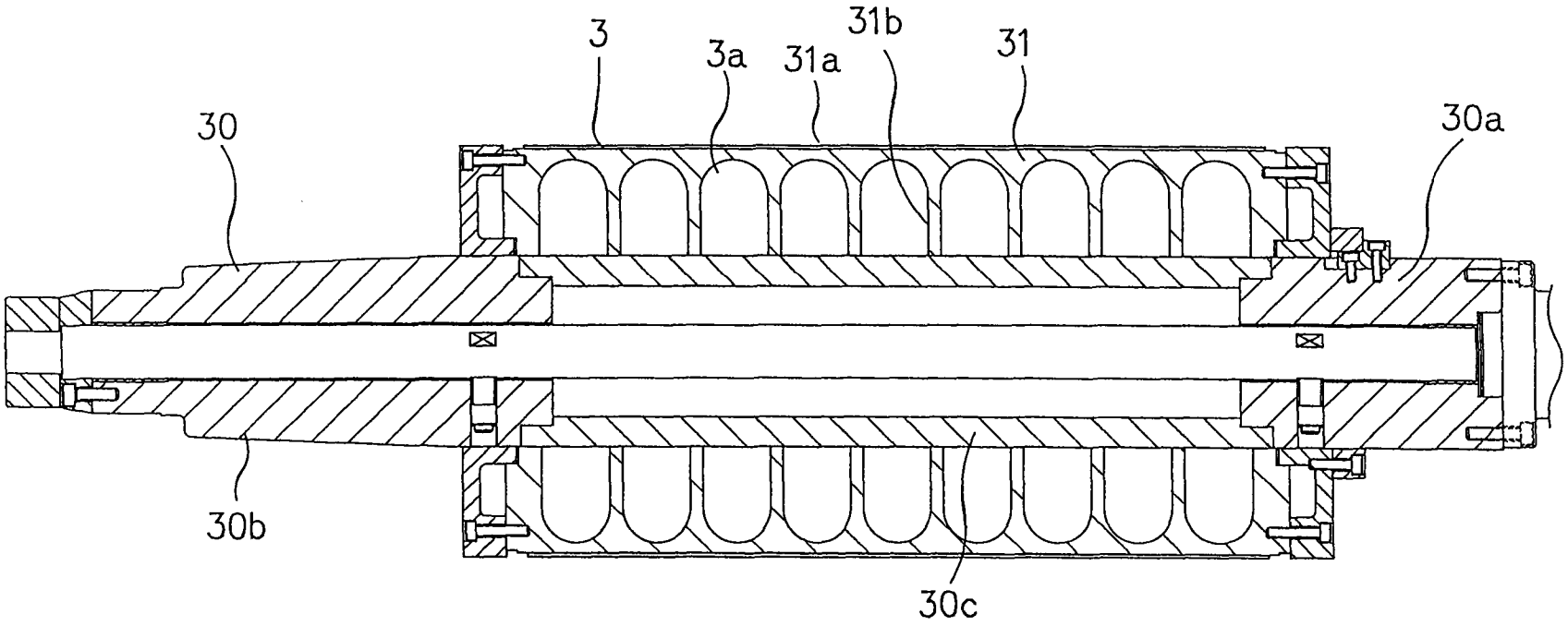
FIG. 10 is a sectional view of a blanket cylinder.

Rotating the drive shaft 71 with the motor for movement 70 rotates the first and second side feed ball screws 73 and 77 synchronously with each other, causing the first and second side auxiliary frame members 50 and 51 to move relative to the first and second side main frame members 1*a* and 1*b*. The motor for movement 70 which needs to be precision controllable may be a servo motor As shown in FIGS. 9 and 10, the plate cylinder shaft 20, the blanket cylinder shaft 30 is hollow in shape, having a cylindrical body 20*c*, 30*c* between a first axial end shaft portion 20*a*, 30*a* and a second axial end shaft portion 20*b*, 30*b*.

The plate cylinder sleeve 21, the blanket cylinder sleeve 31 is constructed of a cylinder 21*a*, 31*a* made of an aluminum alloy and formed on its inner peripheral surface with numbers of disk shaped annular ribs 21*b*, 31*b* axially spaced apart from each other. The outer and inner peripheral surfaces of the cylinder 21*a*, 31*a* are finished by mechanical machining. Mounting by fitting the ribs 21*b*, 31*b* of the cylinder 21*a*, 31*a* on the plate cylinder shaft 20, the blanket cylinder shaft 30 provides a structure having numbers of hollows 2*a*, 3*a* between the plate cylinder shaft 20 and the plate cylinder sleeve 21, between the blanket cylinder shaft 30 and the blanket cylinder sleeve 31.

The plate and blanket cylinders 2 and 3 so constructed can be light-weighted.

The plate and blanket cylinder sleeves 21 and 31, each made of a rib structure having the cylinder 21*a*, 31*a* formed with the ribs 21*b*, 31*b* and made of aluminum alloy are light-weighted, the structure then facilitating operations of exchanging the plate and blanket cylinder sleeves 21 and 31.

Mention is next made of a structure of mounting an impression cylinder 4.

Figure 11:
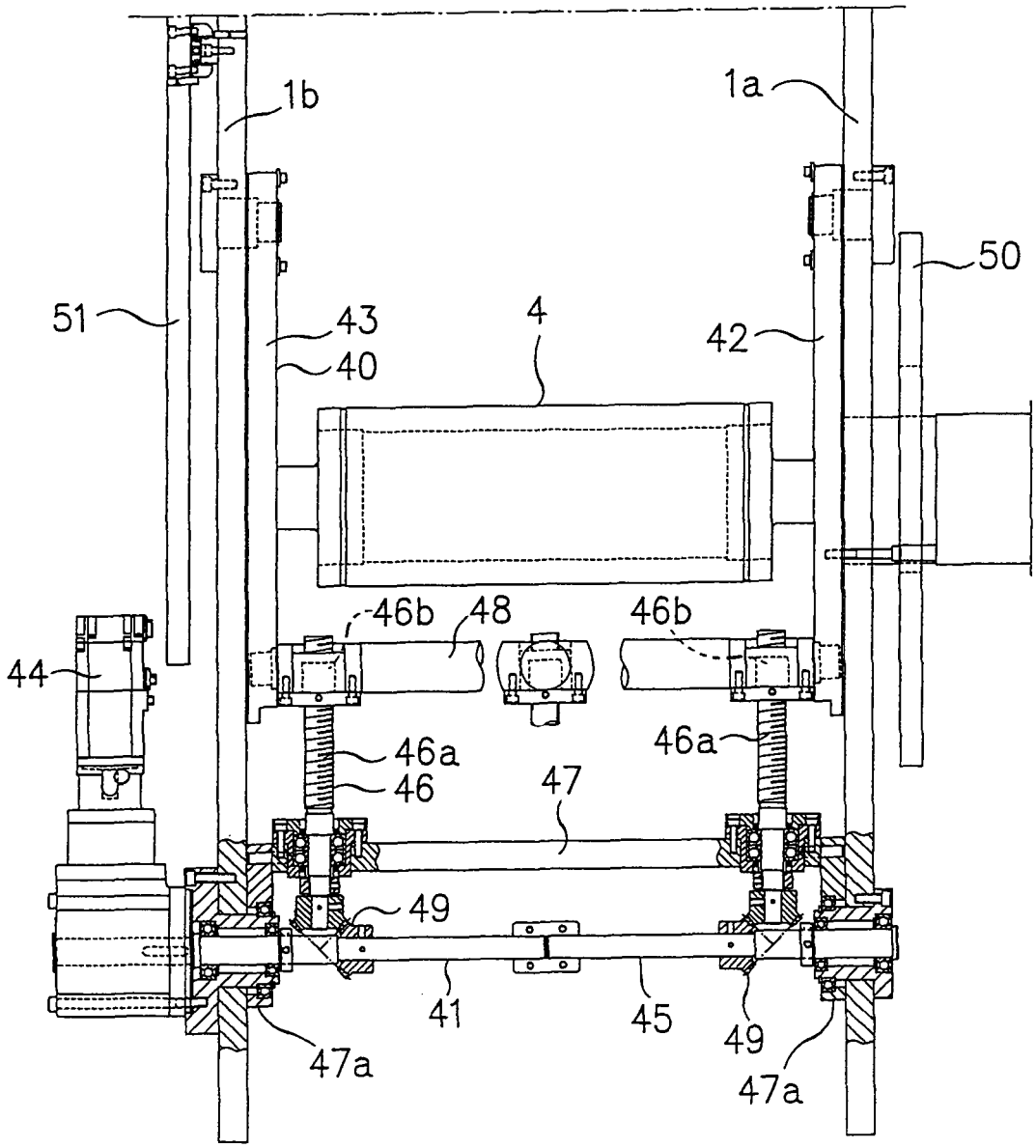
FIG. 11 is a longitudinal sectional view illustrating a mechanism for moving an impression cylinder.

As shown in FIGS. 1 and 11, the main frame 1 has an arm member 40 mounted therein swingably towards the blanket cylinder 3, the arm member 40 having the impression cylinder 4 mounted thereon rotatably.

And, swinging the arm member 40 with a swing mechanism 41 is designed to allow the impression cylinder 4 to move towards and away from the blanket cylinder 3 and thus to change the distance between the centers of the blanket and impression cylinders 3 and 4.

Thus, in printing images different in top-bottom length with a blanket cylinder 3 changed in diameter and an impression cylinder 4, the impression cylinder 4 and blanket cylinder 3 can be brought into contact in proper state with each other by using the arm member 40 swung in accordance with the size of a diameter of the blanket cylinder 3 so as to change the distance between the centers of the impression and blanket cylinders 4 and 3.

The arm member 40 has a first side arm 42 mounted on an inner surface of the first side frame member 1*a* so as to be swingable vertically and a second side arm 43 mounted on an inner surface of the second side frame member 1 so as to be swingable vertically. Between the first and second side arms 42 and 43, the impression cylinder 4 is mounted rotatably.

The impression cylinder 4 is positioned below the blanket cylinder 3. When the first and second side arms 42 and 43 are swung upwards, the impression cylinder 4 is moved towards the blanket cylinder 3. When the first and second side arms 42 and 43 are swung downwards, the impression cylinder 4 is moved away from the blanket cylinder 3.

The swing mechanism 41 comprises a motor for swing 44, a rotary shaft 45 rotatably supported by and between the first and second main frame members 1*a* and 1*b* and rotated by the motor for swing 44, and a ball screw mechanism 46.

The ball screw mechanism 46 has a pair of feed ball screws 46*a* and a pair of ball screw nuts 46*b*.

The first and second side main frame members 1*a* and 1*b* have a pair of levers 47*a* mounted therein rotatably so as to be rotatable about the rotary shaft 45. The levers 47*a* have a bracket 47 mounted between them which has the feed ball screws 46*a* in pairs supported thereon rotatably.

The ball nuts 46*b* in pairs are connected rotatably to a connecting rod 48 rotatably connected between the first and second side arms 42 and 43.

The feed ball screws 46*a* in pair are connected to the rotary shaft 45 via bevel gears 49, respectively.

Rotating the rotary shaft 45 with the motor for swing 44 rotates the feed ball screws 46*a*. Rotation of the feed ball screws 46*a* causes the connecting rod 48 to move vertically to move the first and second side arms 42 and 43 vertically in synchronism with each other.

The motor for swing 44 which needs to control swinging of the arm member 40 in precision should be a servo motor.

The plate and blanket cylinders 2 and 3 are rotated by a single driving motor 80 as described below while the impression cylinder 4 is rotated by another driving motor (not shown).

These driving motors to meet with changing the top-bottom size of print images should preferably be a servo motor, stepping motor or the like but may be any motor that can be controlled to rotate normally and reversely.

Using plate and blanket cylinders having peripheral lengths in millimeter, inch or any other size system to meet with top-bottom lengths of print images in millimeter, inch or any other size system, printing is effected with the plate, blanket and impression cylinders 2, 3 and 4 which are rotated, each without slipping, synchronously with travel of the in-feed printing sheet of paper 65

Mention is next made of a mechanism for driving the plate and blanket cylinders 2 and 3.

Figure 12:
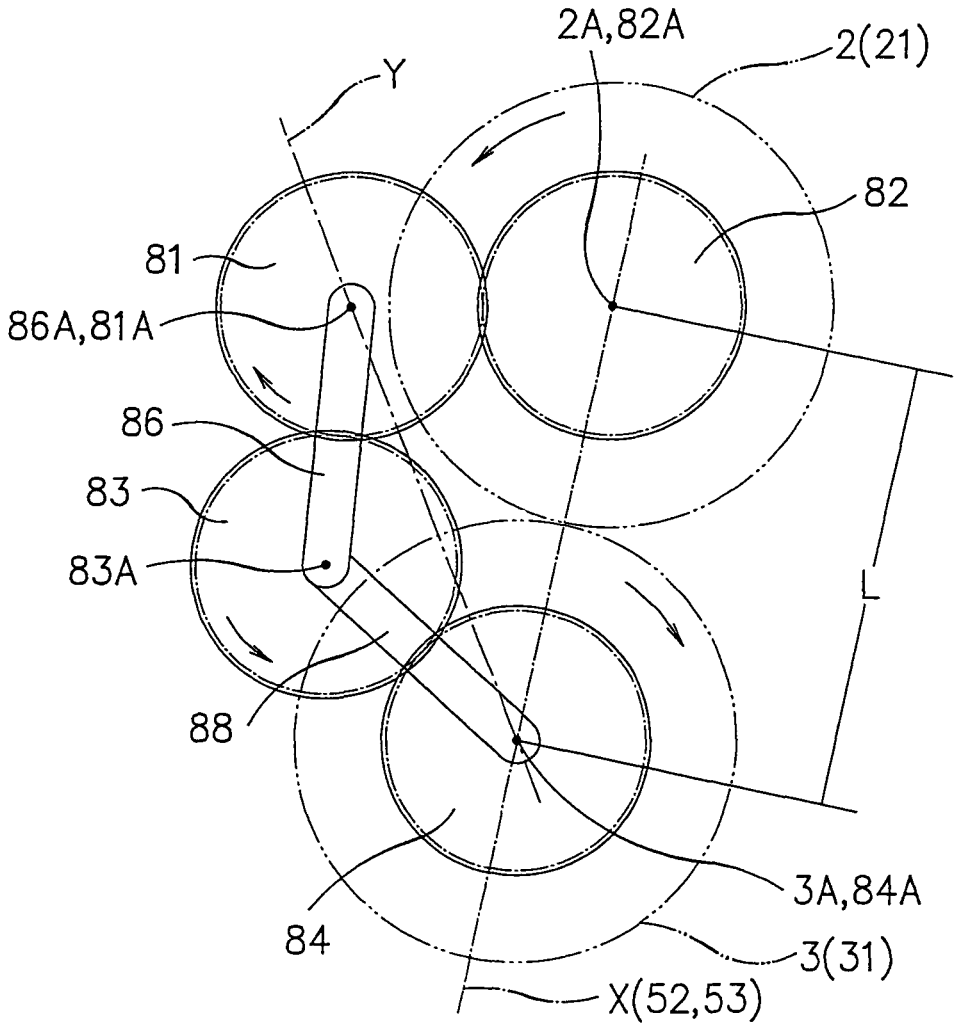
FIG. 12 is a view illustrating in schematic form a state of engagement of gears in a drive mechanism for a plate and a blanket cylinder.

As shown in FIG. 12, the plate cylinder 2 (plate cylinder sleeve 21) and the blanket cylinder 3 (blanket cylinder sleeve 31) are shown in contact with each other. If the diameter of the plate and blanket cylinders 2 and 3 is changed, it is seen that the center 2A of the plate cylinder 2 is unvaried in position and the center 3A of the blanket cylinder 3 is moved on the line X in a direction along the first, second linear guide 52, 53, changing the distance L between the centers of the plate and blanket cylinders 2 and 3.

Figure 13:
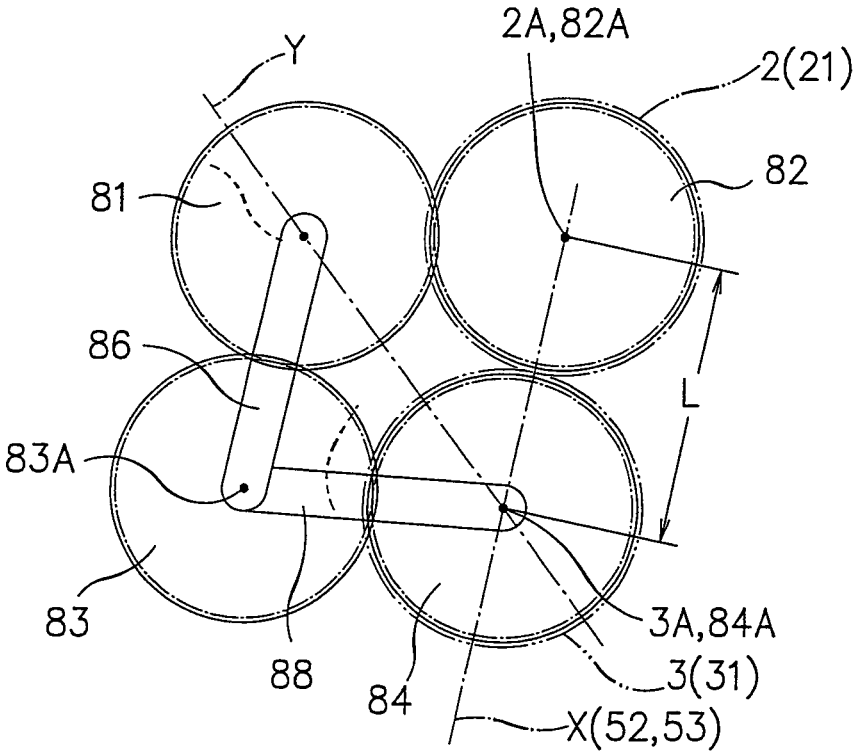
FIG. 13 is an explanatory view of plate and blanket cylinders having their diameter decreased.

For example, if the diameter of the plate and blanket cylinders 2 and 3 is decreased, the center 3A of the blanket cylinder 3 is moved on the line X towards the center 2A of the blanket cylinder 3, decreasing the distance L between the centers as shown in FIG. 13.

Figure 14:
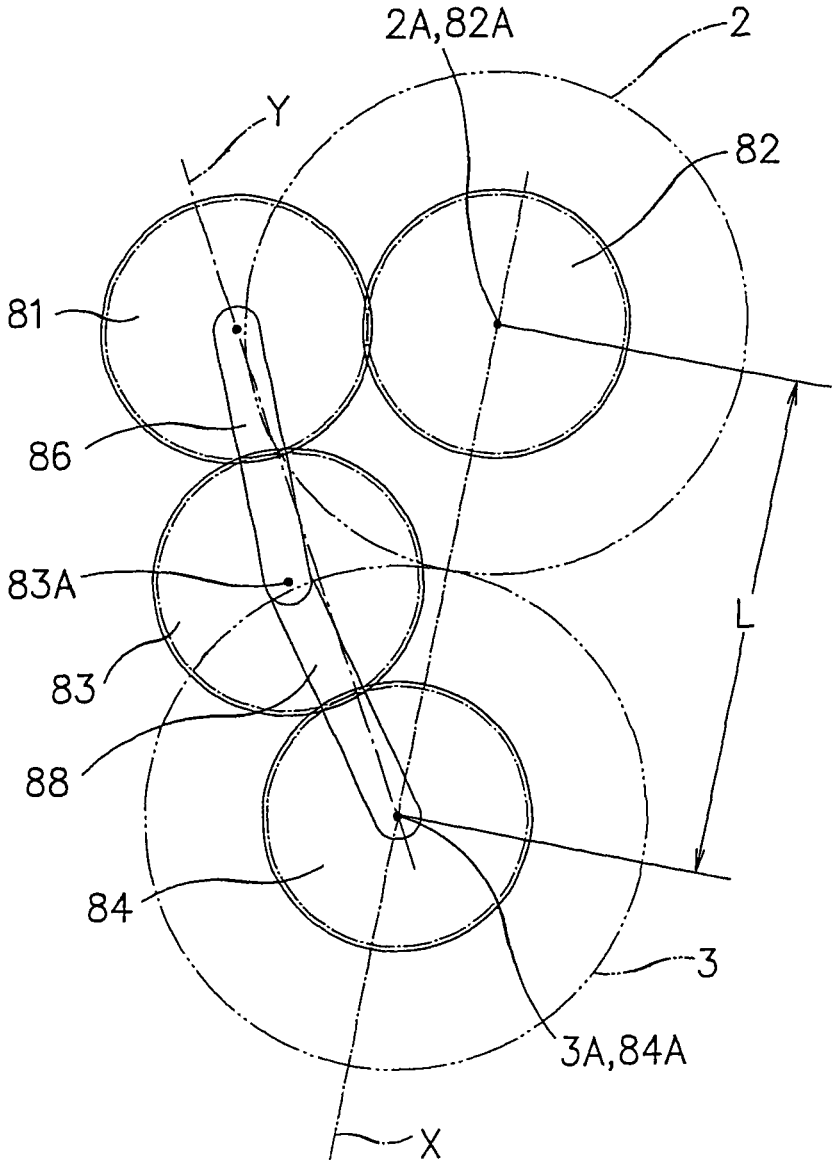
FIG. 14 is an explanatory view of plate and blanket cylinders having their diameter increased.
Figure 15:
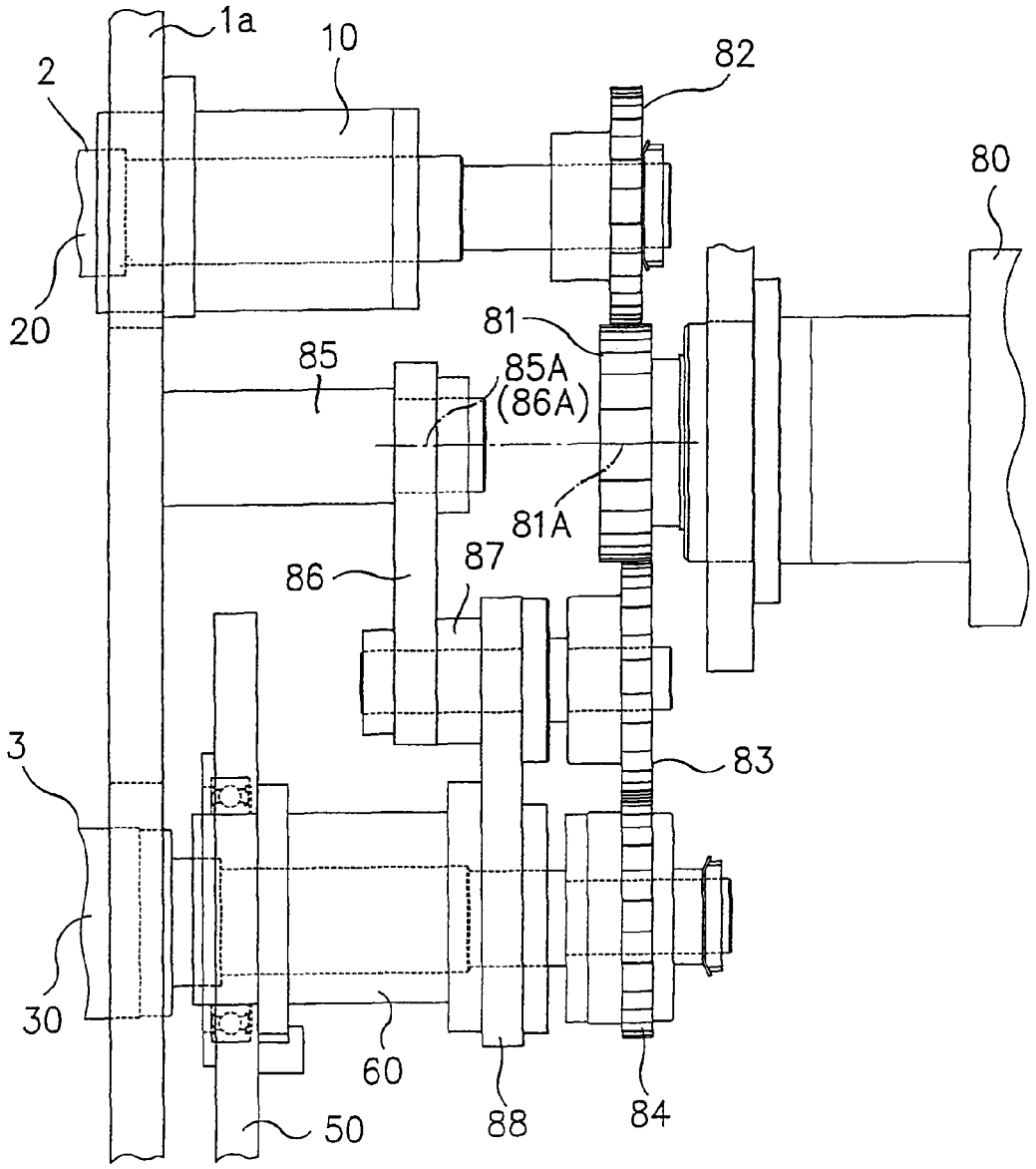
FIG. 15 is a detailed sectional view, developed centered on one axis, of a gear arrangement shown in FIG. 14.

If the diameter of the plate and blanket cylinders 2 and 3 is increased, the center 3A of the blanket cylinder 3 is moved on the line X away from the center 2A of the blanket cylinder 3, increasing the distance L between the centers as shown in FIG. 14.

The plate and blanket cylinders 2 and 3 (the plate and blanket cylinder shafts 20 and 30) are connected to the output shaft of a single motor via gears. Then, in fact the distance L between their centers cannot be increased without disengagement of the gears and cannot be decreased by their presence.

The present invention accordingly provides an arrangement in which a drive gear 81 connected to the output of the drive motor 80 is engaged with a plate cylinder gear 82 fastened to the plate cylinder shaft 20 and an intermediate gear 83, the intermediate gear 83 being engaged with a blanket cylinder gear 84 fastened to the blanket cylinder shaft 30.

The plate cylinder gear 82 has a center 82A which is identical to the center 2A of the plate cylinder 2, and the blanket cylinder gear 84 has a center which is identical to the center 3A of the blanket cylinder 3.

The center 83A of the intermediate gear 83 is positioned at a side opposite to a side of the center 82A of the plate cylinder gear 82 across the line Y connecting the center 81A of the drive gear 81 and the center 84A of the blanket cylinder gear 84 to each other The intermediate gear 83 and the blanket cylinder gear 84 are connected by a link mechanism so that when the blanket cylinder gear 84 is moved on the line X, the intermediate gear 83 in mesh with the drive gear 81 and the blanket cylinder gear 84 is moved to change the distance between the center 81A of the drive gear 81 and the center 84A of the blanket cylinder gear 84.

The link mechanism comprises a first link 86 swingably mounted at its one end portion with a support shaft 85 on the first side main frame member 1*a*, an intermediate shaft 87 mounted to the other end portion of the first link 86, and a second link 88 rotatably mounted at its one end portion to the intermediate shaft 87. The first and second links 86 and 88 are rotatably connected together by the intermediate shaft 87.

The other end portion of the second link 88 is rotatably mounted to the blanket cylinder shaft 30. The second link 88 is rotatable about the center 3A of the blanket cylinder 3.

The intermediate shaft 87 is rotatably connected to the center 83A of the intermediate gear 83 to make the center 83A of the intermediate gear 83 identical to the center of revolution of a part that connects the first and second links 86 and 88 together.

The center 85A of the support shaft 85 (the swinging center 86A of the first link 86) is made identical to the center 81A of the drive gear 81.

Thus, rotating the drive gear 81 with the drive motor 80 rotates the plate cylinder gear 82 and the intermediate gear 83 in one direction and rotates the blanket cylinder 3 in the other direction, thereby rotating the plate cylinder 2 in one direction and the blanket cylinder 3 in the other direction.

Here, the plate and blanket cylinders 2 and 3 are made identical in diameter to each other, the drive gear 81, the plate cylinder gear 82, and the intermediate cylinder 83 and the blanket cylinder gear 84 are made identical in size to one another. The plate and blanket cylinders 2 and 3 are made rotating at an identical speed in opposite directions.

If the diameter of the plate and blanket cylinders 2 and 3 is decreased from the state shown in FIG. 12, the center 3A of the blanket cylinder 3 as shown in FIG. 13 is moved on the line X towards the center 2A of the plate cylinder 2. Then, the first and second links 86 and 88 are rotationally moved into a dogleg shape, and the intermediate gear 83 while in mesh with the drive gear 81 and the blanket cylinder gear 84 has its center 83A moved away from the line Y. This causes the center 84A of the blanket cylinder gear 84 to move towards the center 82A of the plate cylinder gear 82, bringing the plate and blanket cylinders 2 and 3 smaller in diameter into contact with each other.

If the diameter of the plate and blanket cylinders 2 and 3 is increased from the state shown in FIG. 12, the center 3A of the blanket cylinder 3 as shown in FIG. 14 is moved on the line X away from the center 2A of the plate cylinder 2. Then, the first and second links 86 and 88 are rotationally moved into a nearly linear shape, and the center 83A of the intermediate gear 83 is moved towards the line Y. This causes the center 84A of the blanket cylinder gear 84 to move away from the center 82A of the plate cylinder gear 82, bringing the plate and blanket cylinders 2 and 3 larger in diameter into contact with each other.

In this manner, the plate and blanket cylinders 2 and 3 can be rotated with a single drive motor 80, using a gear-type transmission mechanism.

A variable printing machine in the form of implementation mentioned above has advantages as mentioned below.

It allows a plate and a blanket cylinder 2 and 3 changed in diameter to be effectively utilized to print images different in top-bottom length so as to leave no extra space between the succeeding printed images on a continuous sheet or web of paper while permitting continuous paper to be continuously fed to travel, preferably continuously forwards without need to repeat a paper feed cycle of forward travel, stop and backward travel, thus the machine preferably increasing the rate of production and rendering it suitable for large-lot production while enhancing the production efficiency and product quality and reducing the cost of production.

Moreover, feeding of continuous sheet to travel can be simplified so that complex control may be unnecessary with no need for expensive software. An intermittent feed mechanism may be unneeded.

In exchanging the plate and blanket cylinders 2 and 3, only the plate and blanket cylinder sleeves 21 and 31 can be exchanged which can readily be carried manually while the plate and blanket cylinders 20 and 30 remains unchanged which are heavy in weight and size. This makes unnecessary a massive device such as a crane and transport truck and ensures performing a safe exchanging operation.

The plate and blanket cylinder sleeves 21 and 31, in particular when formed in a rib structure and by casting an aluminum alloy, can be much light-weighted and allows an operator to easily handle an exchanging operation manually, facilitating the exchanging operation, with maintenance and inspection that can be carried out in a short period of time, improving the efficiencies of operations and production.

In a variable printing machine of the forms of implementation mentioned above, it is yet possible for a continuous sheet or web of paper to be intermittently fed by repeating a paper feed cycle of forward travel, stop and backward travel to print images different in top-bottom length so as to leave no extra space between the succeeding printed images.

While in the forms of implementation mentioned above the plate and blanket cylinder sleeves 21 and 31 are exchanged, it is yet possible for the plate and blanket cylinders 2 and 3 to be wholly exchanged.

Also, while the plate and blanket cylinders 2 and 3 constitute the printing cylinders, the plate cylinder 2 may only constitute the printing cylinder.

In this case where printing is to be effected with the plate and impression cylinders 2 and 4 in contact with each other, the impression cylinder 4 may be moved towards and away from the plate cylinder 2 whose axial center is held unchanged in position.

While in the forms of implementation mentioned above, the plate and blanket cylinder housing members 15 and 57 having the second end bearing members 16 and 61 are shown mounted in the turning frame member for plate cylinder 12 and the turning frame member for blanket cylinder 54, respectively, the second end bearing members 16 and 61 may directly be mounted in the turning frame member for plate cylinder 12 and the turning frame member 54 for blanket cylinder, respectively, so as to be movable between the support and parted position.

It is also possible that the second end bearing members 16 and 61 may be securely connected to the turning frame member for plate cylinder 12 and the turning frame member for blanket cylinder 54, respectively; the turning frame members 12 and 54 may be made movable axially of the plate and blanket cylinders 2 and 3 while rendering the second end bearing members 16 and 61 each movable between the support position (in which the turning frame member 12 and 54 lie each in the first position) and the parted position; and the frame members 12 and 54 in the parting position, i.e., with the second end bearing members 16 and 61 in the parted position, may each be made turnable between the parting position and the second position.

Figure 16:
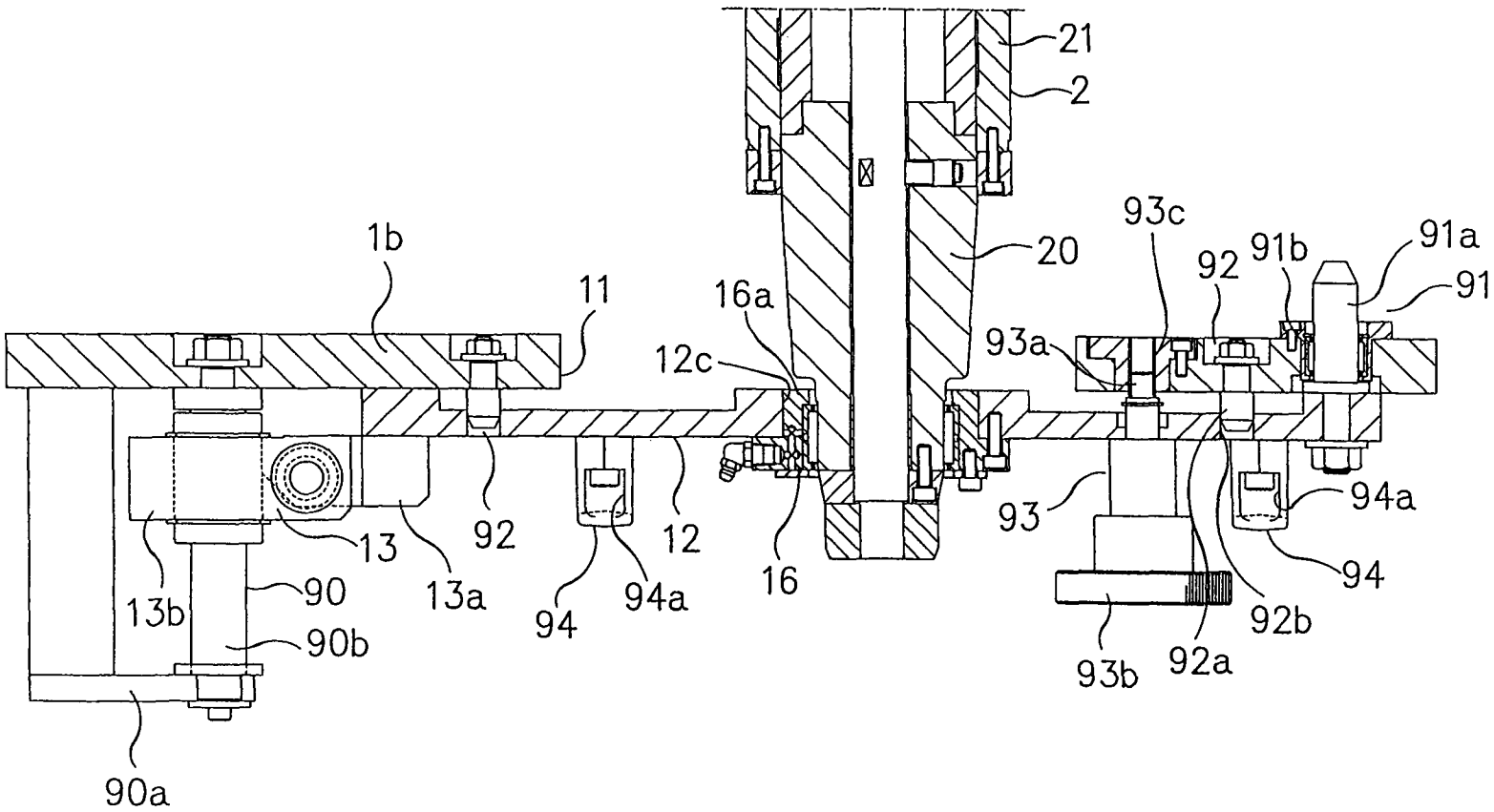
FIG. 16 is a transverse sectional view illustrating a structure in a second form of embodiment in which a turning frame member for plate cylinder is mounted.
Figure 17:
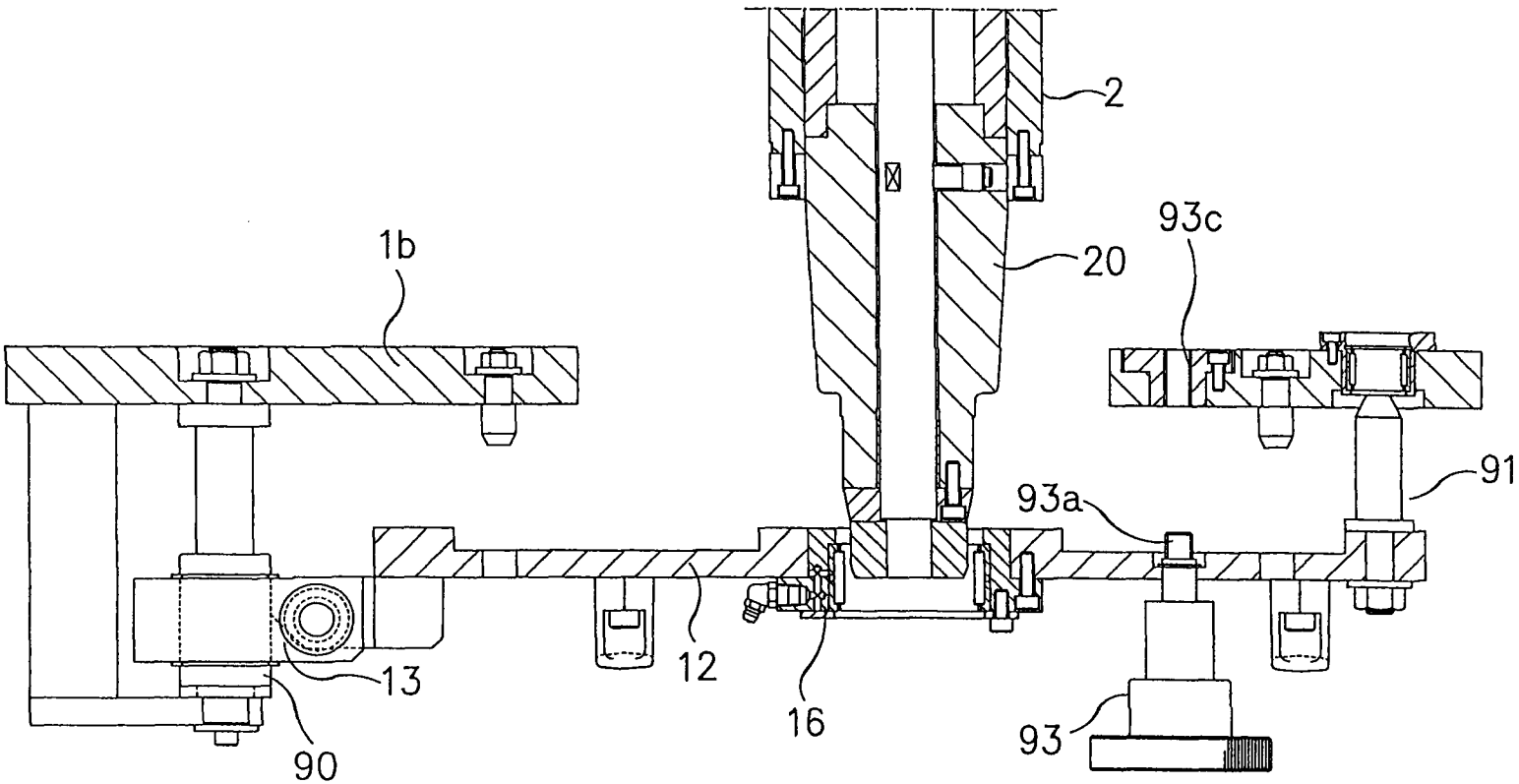
FIG. 17 is a transverse sectional view of the turning frame member for plate cylinder as it is moved to a parting position.
Figure 18:
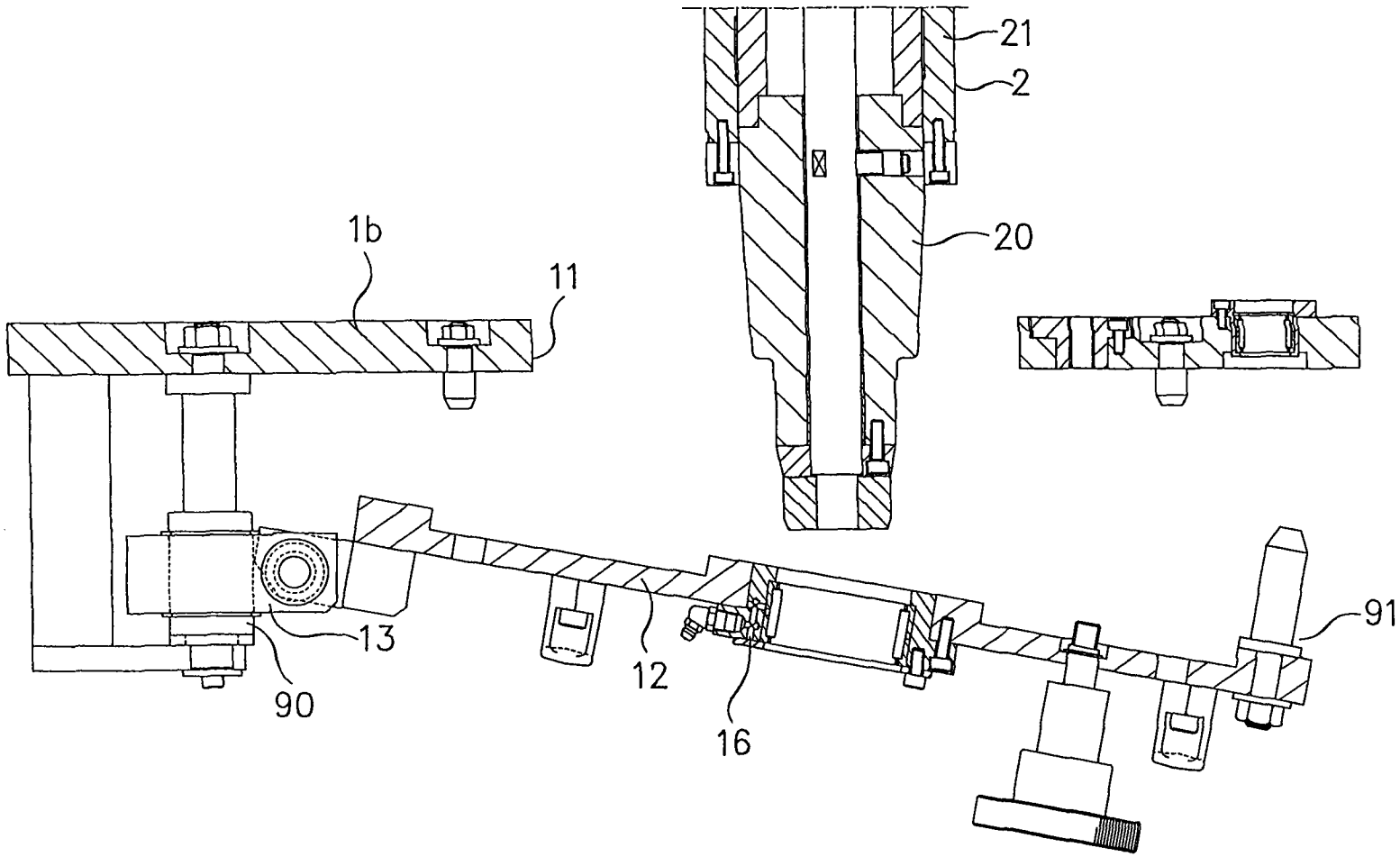
FIG. 18 is a transverse sectional view the turning frame member for plate cylinder as it is turned to a second position.

Mention is next made of a structure of mounting the turning frame member for plate cylinder 12 with reference to FIGS. 16 to 18.

The turning frame member for plate cylinder 12 is formed with a bore 12*c* in which the bearing box 16*a* of the second end bearing member 16 is fitted and secured, thereby connecting and mounting the second end bearing member 16 to the turning frame member for plate cylinder 12.

To one lateral side of the turning frame member for plate cylinder 12, there is attached and fastened one side portion 13*a* of the hinge 13 having the other side portion 13*b*, the one and other side portions 13*a* and 3*b* being of one piece turnable on the hinge 13.

The other side portion 13*b* of the hinge 13 is supported so as to be movable axially of the plate cylinder 2 and so supported by a hinge guide means 90 with which the second side main frame member 1*b* is provided.

The one lateral side of the turning frame member for plate cylinder 12 is thereby supported from the second side main frame member 1*b* so as to be movable axially of the plate cylinder 2 via the hinge 13.

The other lateral side of the turning frame member for plate cylinder 12 is supported from the second side main frame member 1*b* so as to be movable by a selected distance axially of the plate cylinder 2 via a guide means 91.

The hinge guide means 90 has a bracket 90*a* fastened to the second side main frame member 1*b* and a guide shaft 90*b* mounted between the second side main frame member 1*b* and the bracket 90*a*, the guide shaft 90*b* extending parallel to the plate cylinder 2.

And, the other side portion 13*b* of the hinge 13 is made slidably movable along the guide shaft 90*b*.

The guide means 91 has a guide pin 91*a* mounted at a portion on the other lateral side of the turning frame member for plate cylinder 12. The guide pin 91*a* extending parallel to the center axis of the plate cylinder 2 is adapted so as to fit in and to come out of a support bore portion of the second side main frame member 1*b*, e.g., a bearing 91*b* to support the other lateral side portion of the turning frame member for plate cylinder 12 movably until the guide pin 91*a* comes out of the bearing 91*b*.

Thus, the turning frame member for plate cylinder 12 is mounted to the second side main frame member 1*b* so as to be movable axially of the plate cylinder 2 towards and away from, and while maintaining its parallel position to, the second side main frame member 1*b*. The turning frame member for plate cylinder 12 translates between an access position where the second end bearing member 16 takes the support position where it is fitted on, and thereby rotatably supports, the second axial end portion of the plate cylinder shaft 20 as shown in FIG. 16 and a parting position where it takes the parted position where it is extracted from, and thereby releases support of, the second axial end portion of the plate cylinder shaft 20 as shown in FIG. 17.

And, the turning frame member 12 in the access position shown in FIG. 16 is in contact with the outer surface of the second side main frame member 1*b*, closing the opening 11*b*. To wit, it takes the first position mentioned above.

The turning frame member for plate cylinder 12 in the parting position shown in FIG. 17 is turned on the hinge 13 as shown in FIG. 18 to open the opening 11, taking a second position to render the plate cylinder sleeve 21 extractable from the opening 11.

Also, there are provided a positioning means 92 for positioning the turning frame member for plate cylinder 12 in the access position (the first position), a locking means 93 for locking the turning frame member for plate cylinder 12 to hold it in the access position, and an operating member 94 operated to move the turning frame member for plate cylinder from the access position to the parting position.

The positioning means 92 comprises positioning pins and holes 92*a* and 92*b* provided in the right and left hand sides of the turning frame member for plate cylinder 12. When the turning frame member 12 is arrived at the access position, the positioning holes 92*b* are fitted on the positioning pins 92*a* to achieve positioning.

The locking means 93 comprises a locking screw rod 93*a*, a finger knob 93*b* attached to the locking screw rod 93*a* and a locking screw hole 93*c* formed in the second side main frame member 1*b*. When the locking screw rod 93*a* is screwed with the locking screw hole 93*c* by the finger knob 93*b*, the turning frame member for plate cylinder 12 is locked at the access position (see FIG. 16).

The locking means 93 releases the locking state by disengaging the locking screw rod 93*a* from the locking screw hole 93*c* (see FIG. 17).

The locking means 93 is provided in each of the right and left hand side of the turning frame member 12 across the plate cylinder 2.

The operating member 94 includes a handle 94*a*. By putting a hand on the handle 94*a*, the turning frame member 12 is moved from the access position to the parting position.

Such operating members 94 are provided in the right and left hand side of the turning frame member for plate cylinder 12 across the plate cylinder 2 to allow it to be moved by right and left hands.

Figure 19:
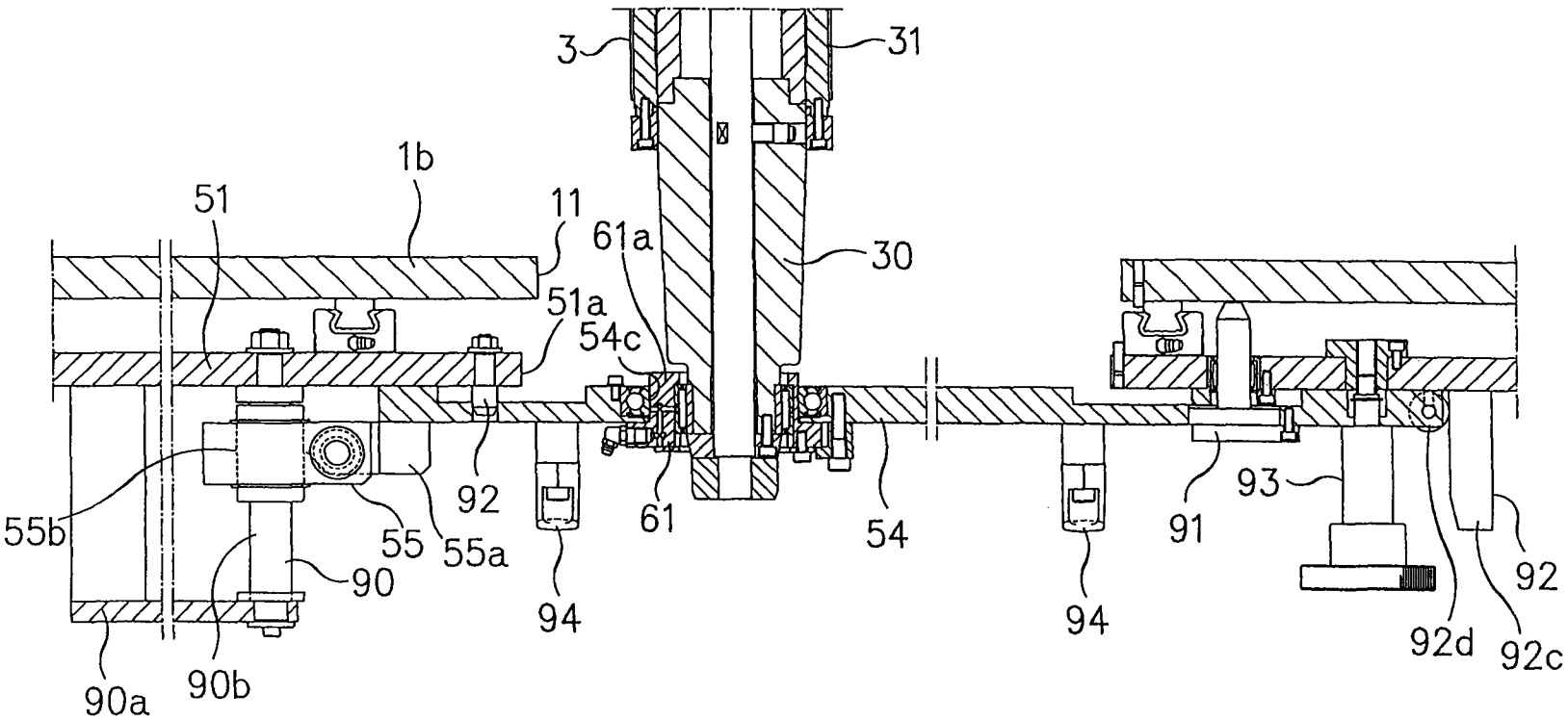
FIG. 19 is a transverse sectional view illustrating a structure in a second form of embodiment in which a turning frame member for blanket cylinder is mounted.
Figure 20:
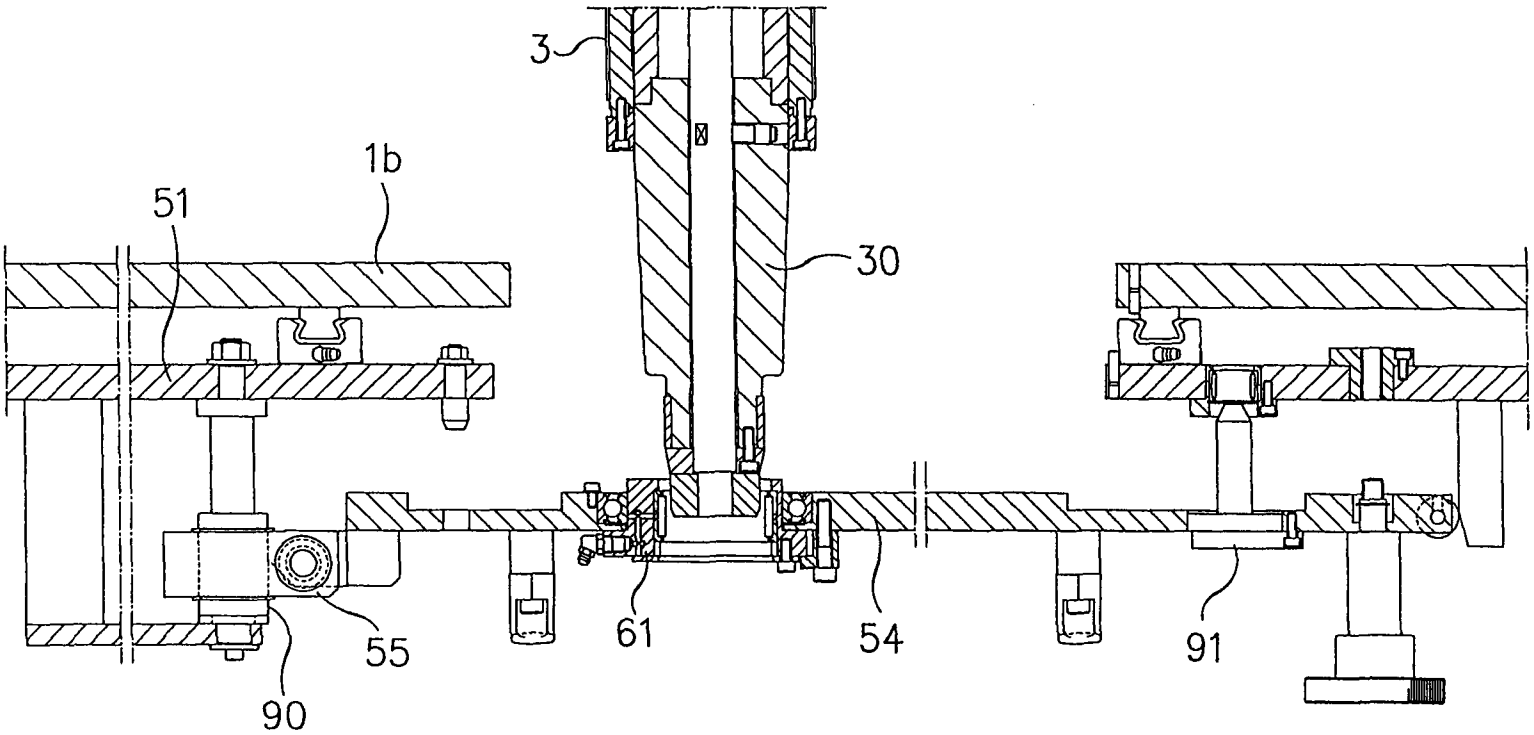
FIG. 20 is a transverse sectional view of the turning frame member for blanket cylinder as it is moved to a parting position.
Figure 21:
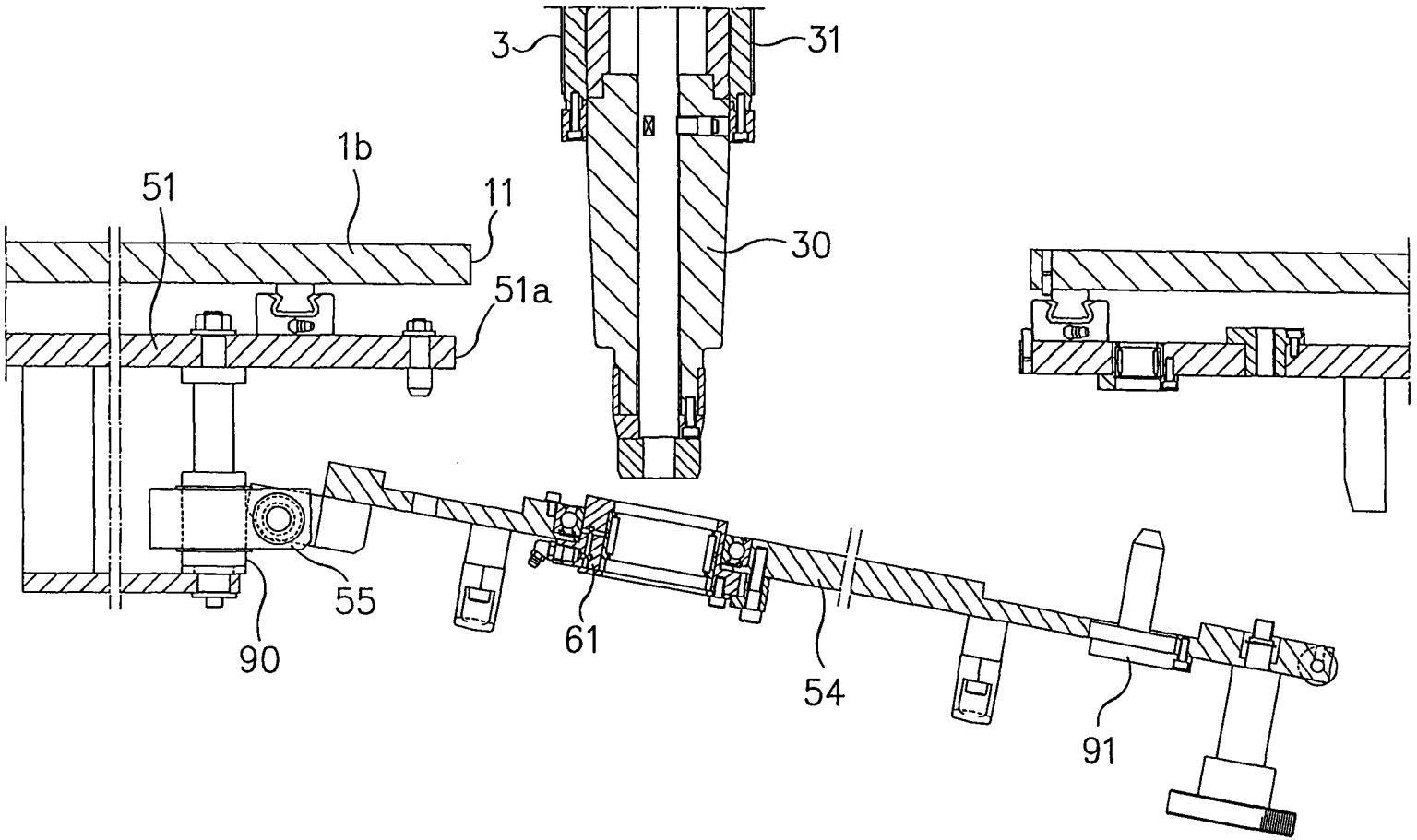
FIG. 21 is a transverse sectional view the of the turning frame member for blanket cylinder as it is turned to a second position.

Mention is next made of a structure of mounting the turning frame member for blanket cylinder 54 with reference to FIGS. 19 to 21.

The bearing box 61*a* of the second end bearing member 61 is fitted in a bore 54*c* in the turning frame member for blanket cylinder 54 to fix the second end bearing member 61 to the turning frame member for blanket cylinder 54.

One side portion 55*a* of the hinge 55 is fastened and attached to one lateral side of the turning frame member for blanket cylinder 54 and the other side portion 55*b* of the hinge 55 is attached to the second side auxiliary frame member 51 with a hinge guide means 90 so as to be movable axially of the blanket cylinder 3, whereas the other lateral side of the turning frame member for blanket cylinder 54 is supported from the second side auxiliary frame member 51 with a guide means 91 so as to be movable axially of the blanket cylinder 3 by a selected distance.

Thus, the turning frame member for blanket cylinder 54 is mounted to the second side auxiliary frame member 51 so as to be movable axially of the blanket cylinder 3 towards and away from, and while maintaining its parallel position to, the second side auxiliary frame member 1*b*. The turning frame member for blanket cylinder 54 translates between an access position where the second end bearing member 61 takes the support position where it is fitted on, and thereby rotatably supports, the second axial end portion of the blanket cylinder shaft 30 as shown in FIG. 19 and a parting position where it takes the parted position where it is extracted from, and thereby releases support of, the second axial end portion of the blanket cylinder shaft 20 as shown in FIG. 20.

And, the turning frame member for blanket cylinder 54 in the access position shown in FIG. 19 is in contact with the outer surface of the second side auxiliary frame member 51, closing the opening 51*a*. To wit, it takes the first position mentioned above.

The turning frame member for blanket cylinder 54 in the parting position shown in FIG. 20 is turned on the hinge 55 as shown in FIG. 21 to open the opening 51*a*, taking a second position to render the blanket cylinder sleeve 31 extractable through the openings 11 and 51*a*.

The hinge guide means 90 and the guide means 91 may be those as shown in and described in connection with FIG. 16.

Also, the turning frame member for blanket cylinder 54 is provided with a positioning means 92, a locking means 93 and an operating means 94. While these means may essentially be those as shown in and described in connection with FIG. 16, the positioning means 92 provided in the right hand side may comprise a guide piece 92*c* fastened and attached to the second side auxiliary frame member 51 and a guide roller 92*d* mounted rotatably at right hand side end of the turning frame member 54. Here, rotational movement of the guide roller 92*d* along the guide piece 92*c* is designed to achieve positioning.

The construction in which to move the blanket cylinder 3 towards and away from the plate cylinder 2 is preferably but not be limited to one as described above. For example, the first and second end bearing members 60 and 61 may be movably provided in the first side main frame 1*a* and the blanket cylinder housing 57, respectively, so that the first and second end bearing members 60 and 61 may be moved by move mechanisms as for the first and second side auxiliary frame members 50 and 51, respectively.

The construction in which to move the impression cylinder 4 towards and away from the blanket cylinder 3 should preferably be but not be limited to one as described above. For example, it may be one in which to move for the blanket cylinder 3 as mentioned above.

What is claimed is:

1. A variable printing machine comprising:

a printing cylinder exchangeably mounted on a main frame of the machine, the printing cylinder being exchangeable from one printing cylinder to another, and an impression cylinder mounted on said main frame so as to be movable towards and away from the printing cylinder, whereby said impression and printing cylinders can be brought into and held in contact with each other to effect printing, in which said printing cylinder comprises a shaft and a sleeve adapted to be fitted on the shaft so that the sleeve can be fitted on and can be extracted from the shaft, the machine including:

a first end bearing member with which said shaft is rotatably supported at a first axial end portion of the shaft in a cantilever structure from said main frame to render said sleeve exchangeable from one sleeve to another, characterized in that the machine includes:

a turning frame member having a second end bearing member for supporting a second axial end portion of said shaft rotatably, the turning frame member being mounted on said main frame so as to be turnable between a first position where it is positioned opposite to a second axial end portion of said printing cylinder and a second position where it is separated from the second axial end portion of the printing cylinder so as to render said sleeve extractable from the shaft, said second end bearing member, relative to the turning frame member in the first position, being movable axially of the printing cylinder, while maintaining its position parallel to the turning frame member, between a support position where the second end bearing member is fitted on, and thereby rotatably supports, the second axial end portion of the shaft and a parted position where it is extracted from, and thereby releases support of, the second axial end portion of the shaft, wherein the turning frame member configured so as to be immovable between the support position and the parted position and, in the parted position, the turning frame member being parallel to the second axial end portion of the printing cylinder.

2. A variable printing machine as set forth in claim 1, wherein the printing cylinder is constituted by a plate and a blanket cylinder, the impression cylinder being brought into and held in contact with the blanket cylinder for printing, said plate cylinder comprises a plate cylinder shaft and a plate cylinder sleeve adapted to be fitted on the plate cylinder shaft so that the sleeve can be fitted on and can be extracted from the plate cylinder shaft, said blanket cylinder comprises a blanket cylinder shaft and a blanket cylinder sleeve adapted to be fitted on the blanket cylinder shaft so that the sleeve can be fitted on and can be extracted from the blanket cylinder shaft, each of said plate and blanket cylinder shafts has a first axial end portion rotatably supported in a cantilever structure with a first end bearing member from said main frame each of said plate and blanket sleeves is exchangeable from one sleeve to another said blanket cylinder shaft is movable towards and away from said plate cylinder shaft, and said impression cylinder is movable towards and away from the blanket cylinder shaft, wherein said main frame has a first and a second side main frame member, the machine including the first and a second end bearing member for plate cylinder and a turning frame member for plate cylinder, the first axial end portion of said plate cylinder shaft being rotatably supported with the first end bearing member for plate cylinder from the first side main frame member, the turning frame member for plate cylinder being mounted on the second side main frame member, turnably between a first position where it is positioned opposite to the second axial end portion of the plate cylinder shaft and a second position where it is separated from the second axial end portion of the plate cylinder shaft so as to render the plate cylinder sleeve extractable from the plate cylinder shaft, and said turning frame member for plate cylinder having the second end bearing member for plate cylinder for supporting a second axial end portion of the plate cylinder shaft so as to be rotatable; the machine further including a first and a second side auxiliary frame member mounted on said first side main frame member and the second side main frame member so as to be movable towards and away from the plate cylinder shaft , respectively, and the first and a second end bearing member for blanket cylinder and a turning frame member for blanket cylinder, the first axial end portion of said blanket cylinder shaft being rotatably supported with the first end bearing member for blanket cylinder from the first side auxiliary frame member, the turning frame member for blanket cylinder being mounted on said second side auxiliary frame member, turnably between a first position where it is positioned opposite to the second axial end portion of the blanket cylinder shaft and a second position where it is separated from the second axial end portion of the blanket cylinder shaft so as to render the blanket cylinder sleeve extractable from the blanket cylinder shaft, and said turning frame member for blanket cylinder having the second end bearing member for blanket cylinder for supporting the second axial end portion of the blanket cylinder shaft so as to be rotatable;

the second end bearing members for plate and blanket cylinders with said turning frame members for plate and blanket cylinders each at the first position being each movable between a support position where it is fitted on, and rotatably supports, the second axial end portion of the plate/blanket cylinder shaft and a parted position where it is extracted from, and releases support of, the second axial end portion of the plate/blanket cylinder shaft.

3. A variable printing machine as set forth in claim 2, wherein said turning frame member for plate cylinder has a plate cylinder housing member provided with said second end bearing member for plate cylinder and being movable between a position where it takes the support position and a position where it takes the parted position, said turning frame member for blanket cylinder has a blanket cylinder housing member provided with the second end bearing member for blanket cylinder and being movable between a position where it takes the support position and a position where it takes the parted position, and move units are provided at opposite sides across the second end bearing members in said housing members for plate and blanket cylinders, respectively, the move units being operable to move the housing members, respectively.

4. A variable printing machine as set forth in claim 2, further including:

a first side arm swingably attached to said first side main frame member, a second side arm swingably attached to said second side main frame member, the impression cylinder being mounted between the first and second side arms, and a means for swinging the first and second side arms in synchronism with each other to move the impression cylinder towards and away from the blanket cylinder.

5. A variable printing machine comprising:

a printing cylinder exchangeably mounted on a main frame of the machine, the printing cylinder being exchangeable from one printing cylinder to another, and an impression cylinder mounted on said main frame so as to be movable towards and away from the printing cylinder, whereby said impression and printing cylinders can be brought into and held in contact with each other to effect printing, in which said printing cylinder comprises a shaft and a sleeve adapted to be fitted on the shaft so that the sleeve can be fitted on and can be extracted from the shaft, the machine including:

a first end bearing member with which said shaft is rotatably supported at a first axial end portion of the shaft in a cantilever structure from said main frame to render said sleeve exchangeable from one sleeve to another, characterized in that the machine includes:

a turning frame member being mounted on said main frame and having a second end bearing member for supporting the second axial end portion of said shaft rotatably, wherein the turning frame member is movable axially of the printing cylinder, while maintaining its position parallel to the turning frame, between a first position where the turning frame member is positioned opposite to the second axial end portion of the shaft so as to allow the second end bearing member to take a support position where it is fitted on, and support rotatably, the second axial end portion of the shaft and a parting position where said second end bearing member takes a parted position where it is extracted from, and releases support of, the second axial end portion of the shaft, and said turning frame member with the second end bearing member in said parted position is turnable between said parting position and a second position where it is separated from the second axial end portion of the printing cylinder so as to render said sleeve extractable from the shaft, wherein, in the parted position, the turning frame member being parallel to the second axial end portion of the printing cylinder.

6. A variable printing machine as set forth in claim 5, wherein the printing cylinder is constituted by a plate and a blanket cylinder, the impression cylinder being brought into and held in contact with the blanket cylinder for printing, said plate cylinder comprises a plate cylinder shaft and a plate cylinder sleeve adapted to be fitted on the plate cylinder shaft so that the sleeve can be fitted on and can be extracted from the plate cylinder shaft, said blanket cylinder comprises a blanket cylinder shaft and a blanket cylinder sleeve adapted to be fitted on the blanket cylinder shaft so that the sleeve can be fitted on and can be extracted from the blanket cylinder shaft, each of said plate and blanket cylinder shafts has a first axial end portion rotatably supported in a cantilever structure with a first end bearing member from said main frame, each of said plate and blanket sleeves is exchangeable from one sleeve to another said blanket cylinder shaft is movable towards and away from said plate cylinder shaft, and said impression cylinder is movable towards and away from the blanket cylinder shaft, in which:

said main frame has a first and a second side main frame member, the machine including a first and a second end bearing member for plate cylinder and a turning frame member for plate cylinder, the first axial end portion of said plate cylinder shaft being rotatably supported with the first end bearing member for plate cylinder from the first side main frame member, the turning frame member for plate cylinder being mounted on the second side main frame member of the main frame and having a second end bearing member for plate cylinder for supporting a second axial end portion of said plate cylinder shaft rotatably, the turning frame member for plate cylinder being movable between a first position where said turning frame member for plate cylinder is positioned opposite to the second axial end portion of the plate cylinder so as to allow the second end bearing member for plate cylinder to take a support position where it is fitted on, and rotatably supports, a second axial end portion of the plate cylinder shaft and a parting position where the second end bearing member for plate cylinder takes a parted position where it is extracted from, and releases support of, the second axial end portion of the plate cylinder shaft, said turning frame member for plate cylinder with the second end bearing member in said parted position being turnable between said parting position and a second position where it is separated from the second axial end portion of the plate cylinder so as to render the plate cylinder sleeve extractable, the machine further including a first and a second side auxiliary frame member mounted on said first and second side main frame members, respectively, so as to be movable towards and away from the plate cylinder shaft, and a first and a second end bearing member for blanket cylinder and a turning frame member for blanket cylinder, the first axial end portion of said blanket cylinder shaft being rotatably supported with the first end bearing member for blanket cylinder from the first side auxiliary frame member, the turning frame member for blanket cylinder being mounted on said second side auxiliary frame member and having the second end bearing member for blanket cylinder for supporting a second axial end portion of said blanket cylinder shaft rotatably, the turning frame member for blanket cylinder being movable between a first position where said turning frame member for blanket cylinder stands opposite to the second axial end portion of the blanket cylinder so as to allow the second end bearing member for blanket cylinder to take a support position where it is fitted on, and rotatably supports, the second axial end portion of the blanket cylinder shaft and a parting position where the second end bearing member for blanket cylinder takes a parted position where it is extracted from, and releases support of, the second axial end portion of the blanket cylinder shaft, said turning frame member for blanket cylinder with the second end bearing member in said parted position being turnable between said parting position and a second position where it is separated from the second axial end portion of the blanket cylinder so as to render the blanket cylinder sleeve extractable.

7. A variable printing machine as set forth in claim 6, further including:

a first side arm swingably attached to said first side main frame member, a second side arm swingably attached to said second side main frame member, the impression cylinder being mounted between the first and second side arms, and a means for swinging the first and second side arms in synchronism with each other to move the impression cylinder towards and away from the blanket cylinder.

* * * * *